US009095029B2

(12) United States Patent
Lu et al.

(10) Patent No.: US 9,095,029 B2
(45) Date of Patent: Jul. 28, 2015

(54) LIGHT SOURCE APPARATUS

(71) Applicant: Industrial Technology Research Institute, Hsinchu (TW)

(72) Inventors: Chien-Chun Lu, New Taipei (TW); Chun-Hsing Lee, Hsinchu (TW); Ya-Hui Chiang, Taoyuan County (TW); Hung-Lieh Hu, Hsinchu (TW); Chia-Fen Hsieh, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 270 days.

(21) Appl. No.: 13/864,235

(22) Filed: Apr. 16, 2013

(65) Prior Publication Data

US 2014/0184088 A1 Jul. 3, 2014

(30) Foreign Application Priority Data

Dec. 28, 2012 (TW) ..... 101151048 A

(51) Int. Cl.
*H05B 33/08* (2006.01)

(52) U.S. Cl.
CPC ..... *H05B 33/0863* (2013.01)

(58) Field of Classification Search
USPC ..... 315/152–153, 210, 294, 297–298; 362/230–231
See application file for complete search history.

(56) References Cited

U.S. PATENT DOCUMENTS

| | | | | |
|---|---|---|---|---|
| 8,506,612 | B2 * | 8/2013 | Ashdown | 607/88 |
| 8,779,669 | B2 * | 7/2014 | Ramer et al. | 315/153 |
| 2008/0123332 | A1 | 5/2008 | Searfoss | |
| 2009/0281604 | A1 | 11/2009 | De Boer et al. | |
| 2010/0063566 | A1 | 3/2010 | Uchiumi et al. | |
| 2010/0157573 | A1 | 6/2010 | Toda et al. | |
| 2010/0244735 | A1 | 9/2010 | Buelow, II | |
| 2010/0244740 | A1 | 9/2010 | Alpert et al. | |
| 2010/0277105 | A1 | 11/2010 | Oyama | |
| 2011/0299277 | A1 | 12/2011 | Ehara | |
| 2012/0170275 | A1 | 7/2012 | Hikmet | |
| 2012/0300452 | A1 | 11/2012 | Harbers et al. | |

FOREIGN PATENT DOCUMENTS

| | | |
|---|---|---|
| CN | 102142503 | 8/2011 |
| CN | 102376832 | 3/2012 |
| TW | 200746459 | 12/2007 |
| TW | 200807753 | 2/2008 |
| TW | 201233243 | 8/2012 |
| TW | 201245634 | 11/2012 |

OTHER PUBLICATIONS

"Office Action of Taiwan Counterpart Application", issued on Jul. 15, 2014, p. 1-p. 15.

(Continued)

*Primary Examiner* — An Luu
(74) *Attorney, Agent, or Firm* — Jianq Chyun IP Office

(57) ABSTRACT

A light source apparatus includes a light-emitting module and a control unit. The light-emitting module is for providing a light. The control unit switches the light emitted from the light-emitting module between a first light and a second light, wherein the circadian stimulus value (CS/P value) of the second light is less than CS/P value of the first light, and the color temperatures of the second light and the first light are substantially the same as each other.

43 Claims, 23 Drawing Sheets

(56) References Cited

OTHER PUBLICATIONS

Wikipedia Foundation, Inc., "Kruithof curve" (http://en.wikipedia.org/w/index.php?title=Kruithof_curve&oldid=543682868), Wikipedia, the free encyclopedia, Mar. 12, 2013, pp. 1-2.
Morita et al., "Effects of Lights of Different Color Temperature on the Nocturnal Changes in Core Temperature and Melatonin in Humans," Applied Human Science Journal of Physiological Anthropology, Jul. 5, 1996, pp. 1-4.
Sato et al., "The effects of exposure in the morning to light of different color temperatures on the behavior of core temperature and melatonin secretion in humans," Biological Rhythm Research, Oct. 2005, pp. 287-292.
Kozaki et al., "Effects of short wavelength control in polychromatic light sources on nocturnal melatonin secretion," Neuroscience Letters, May 13, 2008, pp. 256-259.
Ishibashi et al., "Effects of Mental Task on Heart Rate Variability during Graded Head-up Tilt," Applied Human Science Journal of Physiological Anthropology, Sep. 4, 1999, pp. 225-231.
Michael P. Royer "Tuning Optical Radiation for Visual and Nonvisual Impact," Doctor's thesis, May 2011, The Graduate School, College of Engineering, The Pennsylvania State University.
Sam Berman, "Spectral Diversity Revolutionizes Lighting Practice," Lawrence Berkeley National Laboratory, Oct. 2008, pp. 1-13.
Wout van Bommel, "Incandescent Replacement Lamps and Health," Light & Engineering, vol. 19 Issue 1, Jan. 2011, p. 1-14.
Kozaki et al., "Effect of Color Temperature of Light Sources on Slow-wave Sleep," Journal of Physiological Anthropology and Applied Human Science, Feb. 7, 2005, pp. 183-186.
Yokoi et al., "Effect of Bright Light on EEG Activities and Subjective Sleepiness to Mental Task during Nocturnal Sleep Deprivation," Journal of Physiological Anthropology and Applied Human Science, Sep. 12, 2003, pp. 257-263.
Jo Phipps-Nelson et al., "Blue Light Exposure Reduces Objective Measures of Sleepiness During Prolonged Nighttime Performance Testing," Chronobiology International, Mar. 10, 2009, pp. 891-912.
Cajochen et al., "Dose-response relationship for light intensity and ocular and electroencephalographic correlates of human alertness," Behavioural Brain Research, May 8, 2000, pp. 75-83.
George C. Brainard et al., "Action Spectrum for Melatonin Regulation in Humans: Evidence for a Novel Circadian Photoreceptor," The Journal of Neuroscience, Aug. 15, 2001, pp. 6405-6412.
Katsuura et al., "Effects of Color Temperature of Illumination on Physiological Functions," Journal of Physiological Anthropology and Applied Human Science, Mar. 11, 2005, pp. 321-325.
U.S. Department of Energy, "True Colors LEDs and the relationship between CCT, CRI, optical safety, material degradation, and photobiological stimulation," Solid-State Lighting, Oct. 2014, pp. 1-8.

* cited by examiner

LIGHT SOURCE APPARATUS

CROSS-REFERENCE TO RELATED APPLICATION

This application claims the priority benefit of Taiwan application serial no. 101151048, filed on Dec. 28, 2012. The entirety of the above-mentioned patent application is hereby incorporated by reference herein and made a part of this specification.

TECHNICAL FIELD

The disclosure is generally related to a light source apparatus, and specially related to a light source apparatus able to provide different circadian stimulus lights.

BACKGROUND

Along with Thomas Alva Edison invented the light bulb, the light source produced by the electric power lights up the night, and also the civilization of mankind. With this kind of artificial light source, the human is able to take advantage of the time at night, which thus further led to the development of science, technology and education. In the research field about the impact of a light source on circadian stimulus (CS), Yasukouchi discovered the light source with high color temperature at night can more inhibit the secretion of melatonin than a light source with low color temperature. Next, since 2001, Branard has studied the relationship between the human eyes and the biological effects, so as to further reveal the relationship between the light source and the secretion of melatonin and the biological influences, which can be expressed by FIG. 1 "The relationship curve between a light source and the corresponding circadian stimulus" (2001, Action Spectrum for Melatonin Regulation in Humans: Evidence for a Novel Circadian Photoreceptor). The further studies point out different wavelengths (400 nm-550 nm) of a light source have different influences on CS. Therefore, by judging the influence extent of a light source on human CS, a light source used for night or daytime should be different ones respectively with different appropriate spectral composition so as to provide appropriate artificial lighting sources.

SUMMARY

An embodiment of the disclosure provides a light source apparatus, which includes a light-emitting module and a control unit. The light-emitting module is for providing a light. The control unit makes the light emitted from the light-emitting module switched between a first light and a second light, in which the circadian stimulus value (CS/P value) in view of photometry of the second light is less than CS/P value of the first light, and the color temperatures of the second light and the first light are substantially the same as each other.

An embodiment of the disclosure provides a light source apparatus, which includes a light-emitting module and a control unit. The light-emitting module is for providing a light. The control unit makes the light emitted from the light-emitting module switched between a first light and a second light, in which the CS/P value of the first light is greater than the CS/P value of the second light by over 5% of the CS/P value of the second light.

An embodiment of the disclosure provides an illumination device, which include a first light source and a second light source. The first light source is for providing a first light with a first CS/P value and the second light source is for providing a second light with a second CS/P value, in which the first light and the second light have a substantially same color temperature, and the first CS/P value is different from the second CS/P value.

Several exemplary embodiments accompanied with figures are described in detail below to further describe the disclosure in details.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DETAILED DESCRIPTION OF DISCLOSED EMBODIMENTS

Figure 2A:
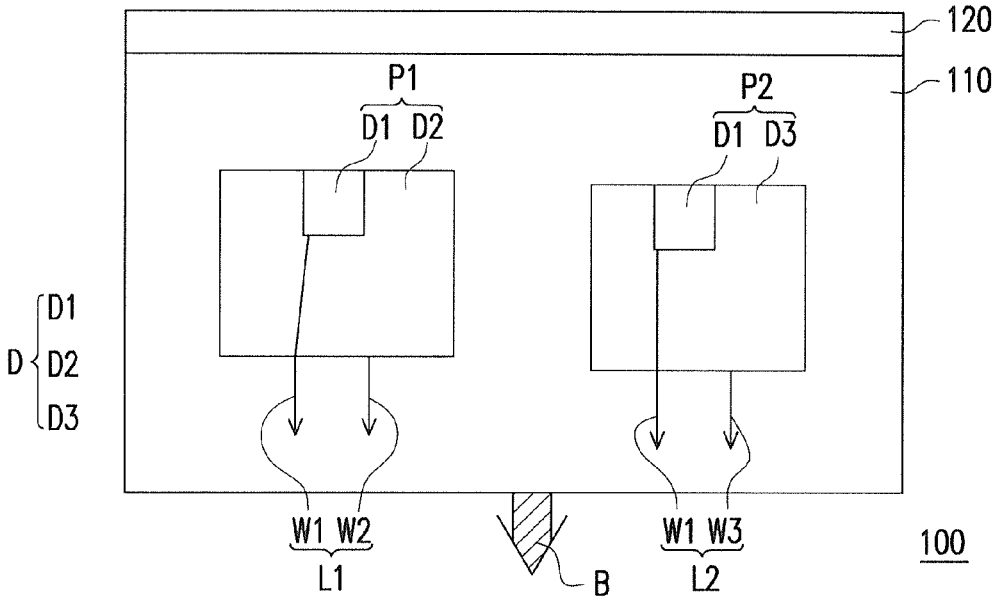
FIG. 2A is a schematic diagram of a light source apparatus in an embodiment of the disclosure.
Figure 2B:
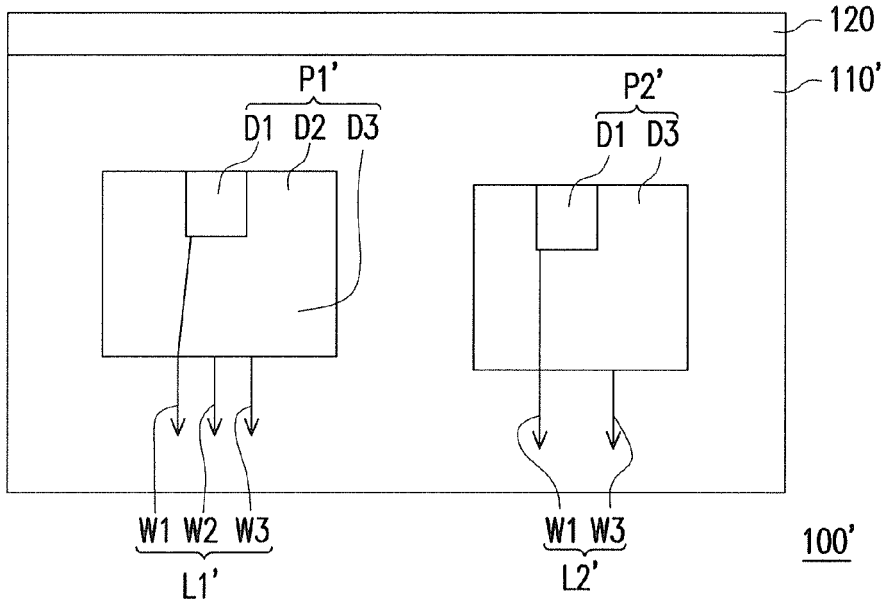
FIG. 2B is a diagram of the variation of the light source apparatus in the embodiment of FIG. 2A.
Figure 2C:
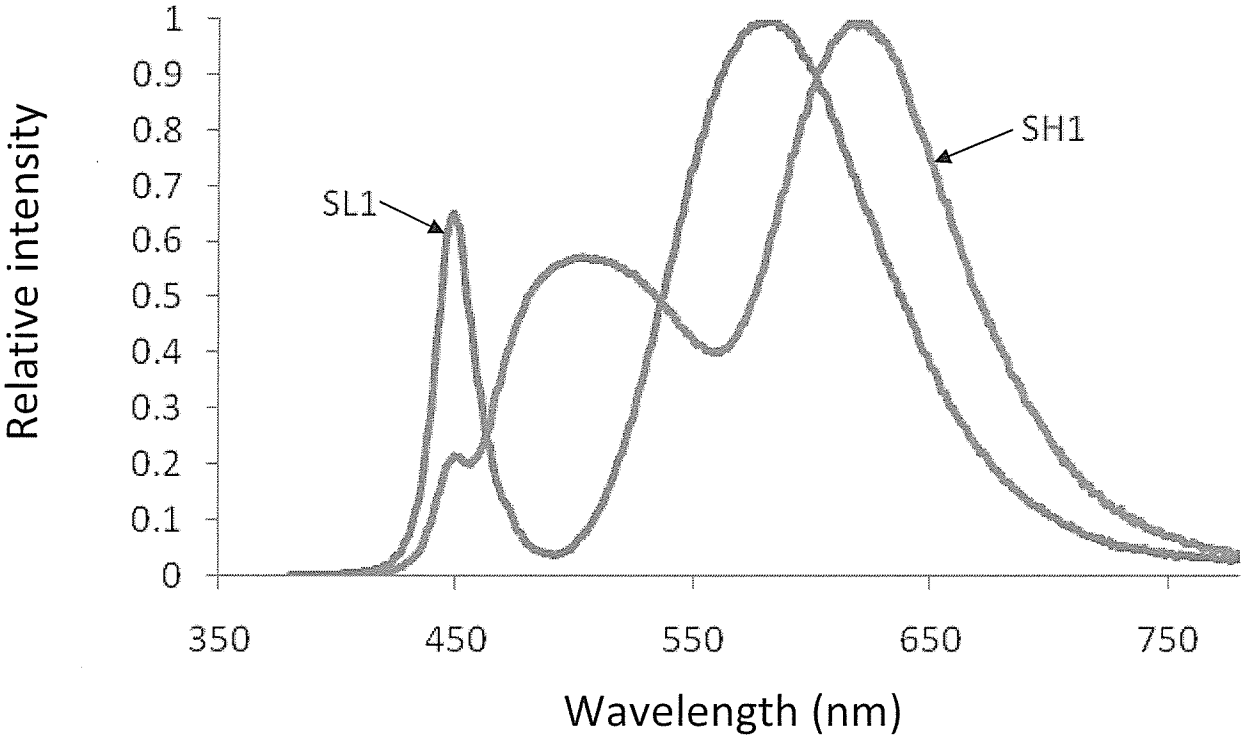
FIG. 2C is a spectrum diagram showing the relative light intensity and the optical wavelength according to the light emitted from the light source apparatus in the embodiment of FIG. 2B.

FIG. 2A is a schematic diagram of a light source apparatus in an embodiment of the disclosure, FIG. 2B is a diagram of the variation of the light source apparatus in the embodiment of FIG. 2A and FIG. 2C is a spectrum diagram showing the relative light intensity and the optical wavelength according to the light source apparatus in the embodiment of FIG. 2B. Referring to FIGS. 2A-2C, in the embodiment, a light source apparatus 100 includes a light-emitting module 110 and a control unit 120. The light-emitting module 110 provides a light B, and in the embodiment, the light B means the light emitted from the light-emitting module 110, which may have a divergence angle and is not limited to a specific transmitting direction. The control unit 120 is for switching the light B emitted from the light-emitting module 110 between a first light L1 and a second light L2, in which the CS/P value in view of photometry of the second light L2 is less than the CS/P value of the first light L1, and the color temperatures of the first light L1 and the second light L2 are substantially the same as each other. Thus, the light source apparatus 100 can provide the first light L1 with high CS/P value or the second light L2 with low CS/P value by selection according to the real application environment, time and goal without making the user easily noticed of the change of the optical color temperature so as to maintain the natural circadian rhythm of user and meanwhile to provide enough light source.

Figure 1:
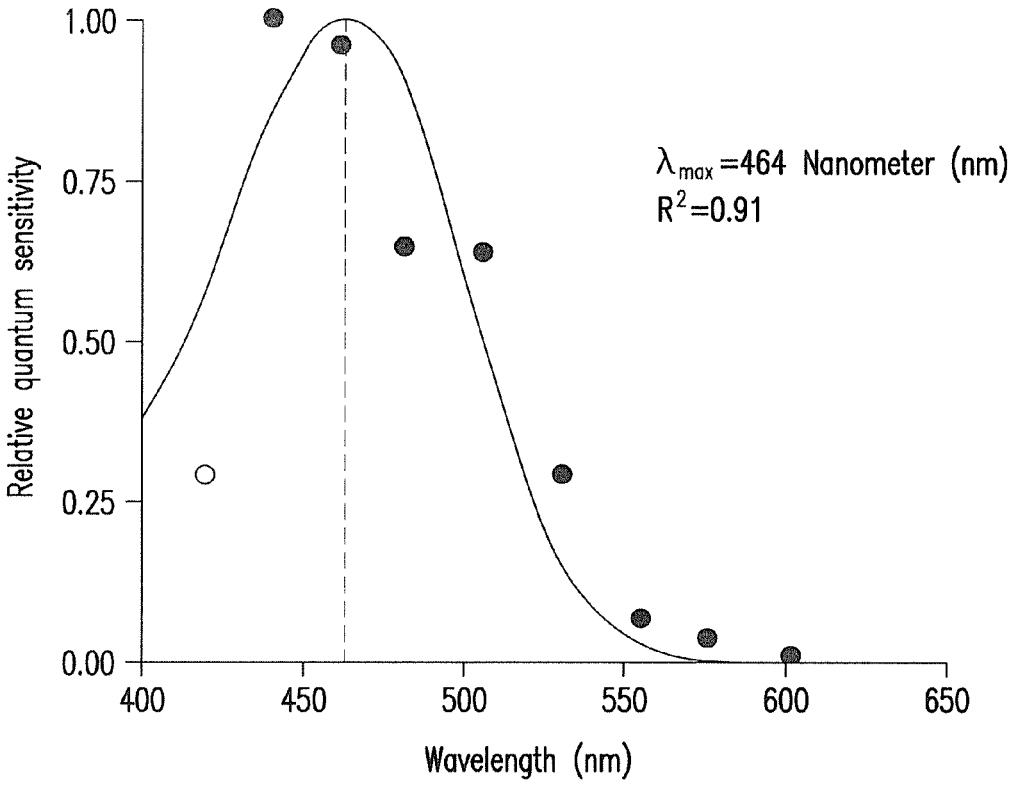
FIG. 1 is a diagram illustrating the relationship curve between a light source and the corresponding CS/P.
Figure 3:
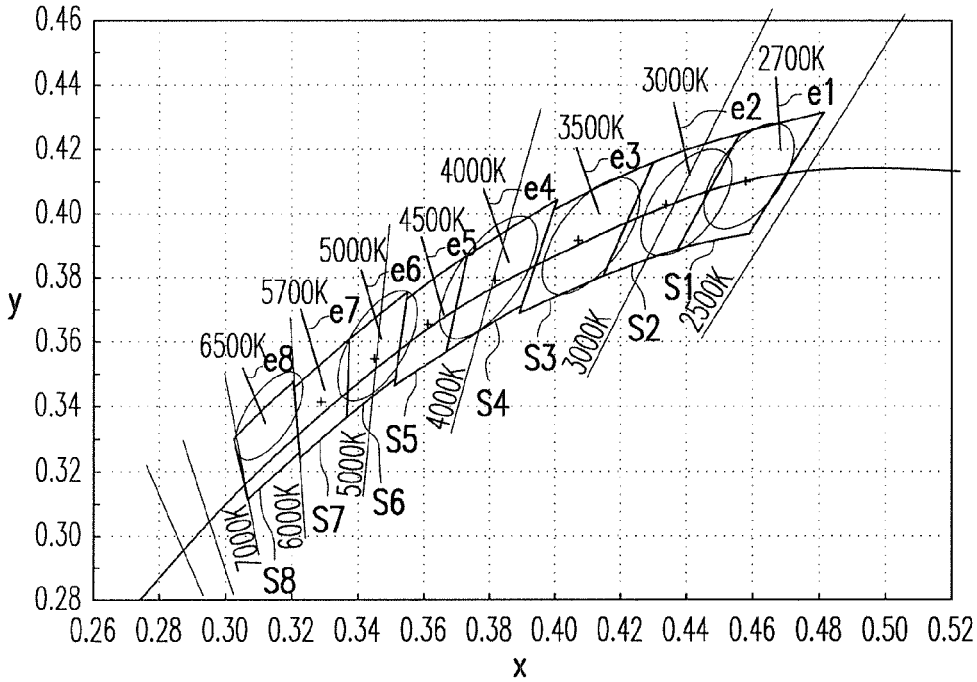
FIG. 3 is a diagram showing color space coordination patterns of same color temperatures defined by American National Standard Institute (ANSI).

In more details, in the embodiment, the definition of CS/P value is expressed by the following formula:

$$CS = \int_{vis} CS(\lambda) \cdot P_{0\lambda} \cdot d\lambda$$

$$P = \int_{vis} P(\lambda) \cdot P_{0\lambda} \cdot d\lambda$$

$$CS/P = \frac{\int_{vis} CS(\lambda) \cdot P_{0\lambda} \cdot d\lambda}{\int_{vis} P(\lambda) \cdot P_{0\lambda} \cdot d\lambda}$$

wherein CS(λ) represents human circadian function, P(λ) represents human photopic function, $P_{0\lambda}$ represents spectrum after completing light blending, CS represents CS/P value of the spectrum after completing light-blending, and P represents light intensity of the spectrum after completing light-blending, in which P(λ) is defined according to Commission International de l'éclairage (CIE); human circadian function CS(λ) can refer to the "action spectrum (1997)" introduced by Prof. Brainard as shown by FIG. 1, "human invisible circadian function (2005)" introduced by Mark Rea and the circadian function stated in German pre-standard, DIN V. The light source apparatus 100 of the disclosure can be suitable for various circadian functions. FIG. 3 is a diagram showing color space coordination patterns of same color temperatures defined by American National Standard Institute (ANSI). Referring to FIG. 3, in the embodiment, "same color temperatures" is defined according to ANSI. In other words, for any light source with the same color temperature designed following the ANSI standard, the color difference of the light source is uneasily noticed by human eyes. The detail coordinates corresponding to the color space coordination patterns in FIG. 3 defined by ANSI are listed in the following table 1:

TABLE 1

| | 2700 K | | 3000 K | | 3500 K | | 4000 K | |
|---|---|---|---|---|---|---|---|---|
| | X | Y | X | Y | X | Y | X | Y |
| Center point | 0.4578 | 0.4101 | 0.4338 | 0.4030 | 0.4073 | 0.3917 | 0.3818 | 0.3797 |
| Tolerance quadrilateral | 0.4813 | 0.4319 | 0.4562 | 0.4260 | 0.4299 | 0.4165 | 0.4006 | 0.4044 |
| | 0.4562 | 0.4260 | 0.4299 | 0.4165 | 0.3996 | 0.4015 | 0.3736 | 0.3874 |
| | 0.4373 | 0.3893 | 0.4147 | 0.3814 | 0.3889 | 0.3690 | 0.3670 | 0.3578 |
| | 0.4593 | 0.3944 | 0.4373 | 0.3893 | 0.4147 | 0.3814 | 0.3898 | 0.3716 |
| | 4500 K | | 5000 K | | 5700 K | | 6500 K | |
| | X | Y | X | Y | X | Y | X | Y |
| Center point | 0.3611 | 0.3658 | 0.3447 | 0.3553 | 0.3287 | 0.3417 | 0.3123 | 0.3282 |
| Tolerance quadrilateral | 0.3736 | 0.3874 | 0.3551 | 0.3760 | 0.3376 | 0.3616 | 0.3205 | 0.3481 |
| | 0.3548 | 0.3736 | 0.3376 | 0.3616 | 0.3207 | 0.3462 | 0.3028 | 0.3304 |
| | 0.3512 | 0.3465 | 0.3366 | 0.3369 | 0.3222 | 0.3243 | 0.3068 | 0.3113 |
| | 0.3670 | 0.3578 | 0.3515 | 0.3487 | 0.3366 | 0.3369 | 0.3221 | 0.3261 |

wherein the data ranges in Tab 1 can be corresponding to the color temperature ranges S1-S8 of tolerance quadrilateral in FIG. 3 by calculation. For example, the CS/P values within the color temperature range S1 of tolerance quadrilateral in FIG. 3 are very close to the human eyes, and analogy to the rest. In more details, the tolerance quadrilateral in Tab 1 can be calculated to be a color temperature range, as shown by Tab 2:

TABLE 2

| Nominal correlated color temperature (CCT) | Target-related color temperature (K) and tolerance |
|---|---|
| 2700 K | 2725 ± 145 |
| 3000 K | 3045 ± 175 |
| 3500 K | 3465 ± 245 |
| 4000 K | 3985 ± 275 |
| 4500 K | 4503 ± 243 |
| 5000 k | 5028 ± 283 |
| 5700 K | 5665 ± 355 |
| 6500 K | 6530 ± 510 |

wherein the data ranges in Tab 2 can be calculated to be ellipse color temperature ranges e1-e8 in FIG. 3. In more details, these ellipse color temperature ranges e1-e8 are David MacAdam ellipses. For example, the color temperature coordinates within the ellipse color temperature range e1 are very close to the human eyes, and analogy to the rest. It should be noted that the coordinate data in Tab 1 and Tab 2 are example to indicate that the color temperatures in the embodiment are substantially the same only. The real coordinate data should refer to the up-to-date definition of ANSI, which the disclosure is not limited to. In another embodiment, "the color temperatures are the substantially same" means the color temperatures are within a same ellipse color temperature range. In this way, the light source apparatus 100 can select a light source with different CS/P value according to the real application environment, the time and the goal without making the user easily noticed of the change of the optical color temperature, so as to maintain the user's circadian rhythm and meanwhile to provide enough light source.

In more details, referring to FIG. 2A, the control unit 120 can make the light-emitting module 110 switched between a plurality of light-emitting modes, and these light-emitting modes include a first circadian stimulus mode and a second circadian stimulus mode. The light-emitting module 110 includes a plurality of light-emitting units D, and these light-emitting units D can include electroluminescent light-emitting element, light-induced light-emitting element or a combination thereof. The light-emitting units D include at least one first light-emitting unit D1, at least one second light-emitting unit D2 and at least one third light-emitting unit D3. The first light-emitting unit D1 provides a first sub-light beam W1, the second light-emitting unit D2 provides a second sub-light beam W2, and the third light-emitting unit D3 provides a third sub-light beam W3, in which at least one range of wave peaks of the first sub-light beam W1 can be greater than 420 nm but less than 480 nm, at least one range of wave peaks of the second sub-light beam W2 can be greater than 480 nm but less than 540 nm, and at least one range of wave peaks of the third sub-light beam W3 can be greater than 540 nm.

When the control unit 120 makes the light-emitting module 110 switched to the first circadian stimulus mode, the control unit 120 makes the first portion P1 of the light-emitting units D provide the first light L1, in which the first light L1 includes the first sub-light beam W1 and the second sub-light beam W2; when the control unit 120 makes the light-emitting module 110 switched to the second circadian stimulus mode, the control unit 120 makes the second portion P2 of the light-emitting units D provide the second light L2, in which the second light L2 includes the first sub-light beam W1 and the third sub-light beam W3. The color temperatures of the first light L1 and the second light L2 are substantially the same, so that the CS/P value can be changed to meet different requirements without affecting the color temperature feeling of the user.

In addition, the light source apparatus 100' in FIG. 2B is similar to the light source apparatus 100 in FIG. 2A, and in FIG. 2B, each the light-emitting unit provides a range of wave peaks same as the corresponding range of wave peaks in the embodiment of FIG. 2A. The difference of FIG. 2B from FIG. 2A rests in that the first portion P1' of the light source apparatus 100' in FIG. 2B further includes a third light-emitting unit D3.

Under the first circadian stimulus mode, the first light L1' provided by the first portion P1' can include the first sub-light beam W1, the second sub-light beam W2 and the third sub-light beam W3; under the second circadian stimulus mode, the second light L2' provided by the second portion P2' can include the first sub-light beam W1 and the third sub-light beam W3.

The frequency spectrum of the case of FIG. 2B after finishing the light-blending is shown by FIG. 2C. Since the CS/P value of the second sub-light beam W2 is greater than the CS/P value of the third sub-light beam W3, the CS/P values of the first light L1' and the second light L2', due to the different light-blending spectrums thereof, are different from each other regardless the first light L1' and the second light L2' have the same color temperature 3000K. The spectrum of the first light L1' is shown by the light-blending spectrum curve SH1 in FIG. 2C and the CS/P value is roughly 0.43 by calculation; the light-blending spectrum of the second light L2' is shown by the spectrum curve SL1 in FIG. 2C and the CS/P value is roughly 0.27 by calculation, which mean the CS/P value of the first light L1' by calculation is roughly 159% of the CS/P value of the second light L2'. In this way, the CS/P values of the second light L2' and the first light L1' are different from each other more noticed, but the disclosure does not limit the above-mentioned difference to achieve the above-mentioned goal.

Figure 2D:
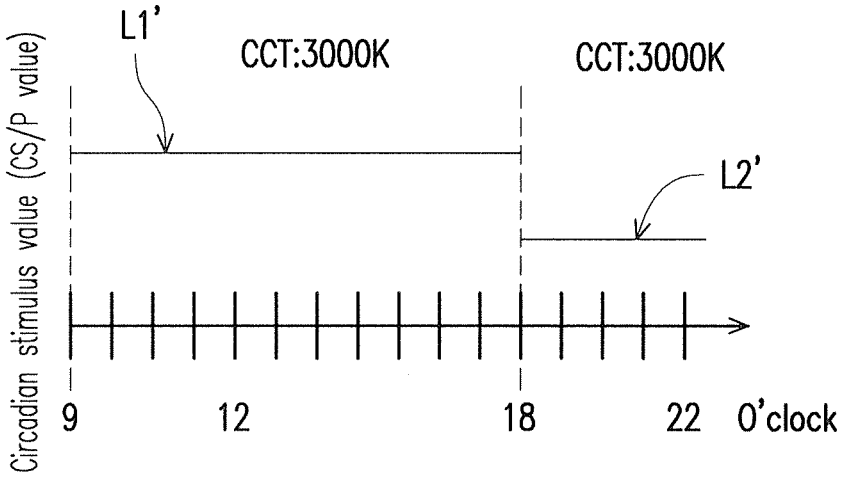
FIG. 2D is a timing diagram showing different illumination modes in different periods for the light source apparatus in the embodiment of FIG. 2B.

Moreover, the control unit 120 makes the light B emitted from the light-emitting module 110' in a plurality of periods of a whole day switched to the first circadian stimulus mode (for providing the first light L1') or the second circadian stimulus mode (for providing the second light L2') according to the requirement. In more details, FIG. 2D is a timing diagram showing different illumination modes in different periods for the light source apparatus in the embodiment of FIG. 2B. Referring to FIGS. 2B and 2D, taking an example, the light source apparatus 100' can be used for illumination of hotel, where the first light L1' with color temperature of 3000K and a higher CS/P value is provided in the working period (as shown in 9:00-18:00 by FIG. 2D) so as to boost the alertness and working vitality of the service personnel and meanwhile bring guests visual warmth and comfort feeling; the light-emitting module 110' in the light source apparatus 100' is switched to provide the second light L2' with the same color temperature of 3000K and a lower CS/P value in the evening period (as shown in 18:00-22:00 of FIG. 2D) so as to reduce the circadian stimulus on the service personnel on evening duty and the quests without affecting the illumination color temperature so as to avoid affecting the melatonin secretion to affect the health of the service personnel and the guests. It should be noted that the timing of FIG. 2D is an example to describe the embodiment only, the disclosure is not limited thereto, and in other embodiments, the timing can be varied according to the implementation requirement.

Figure 2E:
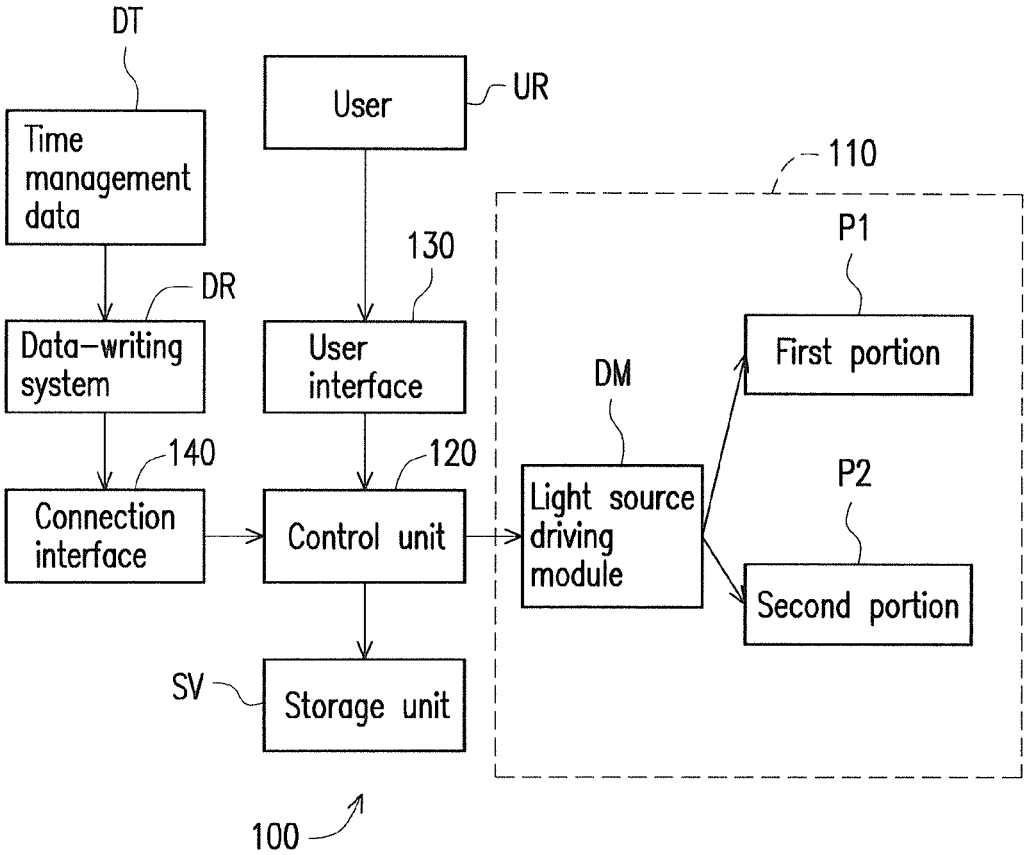
FIG. 2E is a block chart of the light source apparatus of FIG. 2A.

FIG. 2E is a block chart of the light source apparatus of FIG. 2A. Referring to FIG. 2E, in the embodiment, the light source apparatus 100 further includes a user interface 130, and the control unit 120 can decide the present illumination modes of the light source apparatus 100 according to a signal input from the user interface 130 corresponding to the operation of the user UR. In more details, the control unit 120 is, for example, a microprocessor, and can make the light-emitting module 110 in a plurality of periods respectively switched to different illumination modes according to a time management data DT, wherein the time management data DT is related to biological clock. For example, the time management data DT can be the mode-switching time data in the timing diagram in FIG. 2D, which the disclosure is not limited to. Moreover, the light source apparatus 100 includes a data-writing system DR, the time management data DT can be received and stored in a storage unit SV through the connection between the data-writing system DR and the control unit 120, and the control unit 120 can control itself by loading the time management data DT from the storage unit SV to make a light source driving module DM drive the first portion P1 or the second portion P2 so as to achieve the effect in the embodiment of FIG. 2A. On the other hand, the light source apparatus 100 further includes a connection interface 140 to transmit the time management data DT from the data-writing system DR to the control unit 120, in which the connection interface 140 is a cable connection interface or a wireless connection interface. For example, the connection interface 140 may be a manual switch or a remote, and the user UR can use the manual switch or the remote to select or alter the illumination mode of the light source apparatus 100. The light source apparatus 100 can also automatically select or alter the illumination mode depending on the time to meet the requirement of the user UR according to the content of the time management data DT.

In the embodiment of FIG. 2A however, the light-emitting module 110 of the light source apparatus 100 can provide the first light L1 and the second light L2 with the same color temperatures but different CS/P values; in other embodiments, the light-emitting module 110 of the light source apparatus 100 can provide the lights with the same or different color temperatures and different CS/P values as well.

Figure 4A:
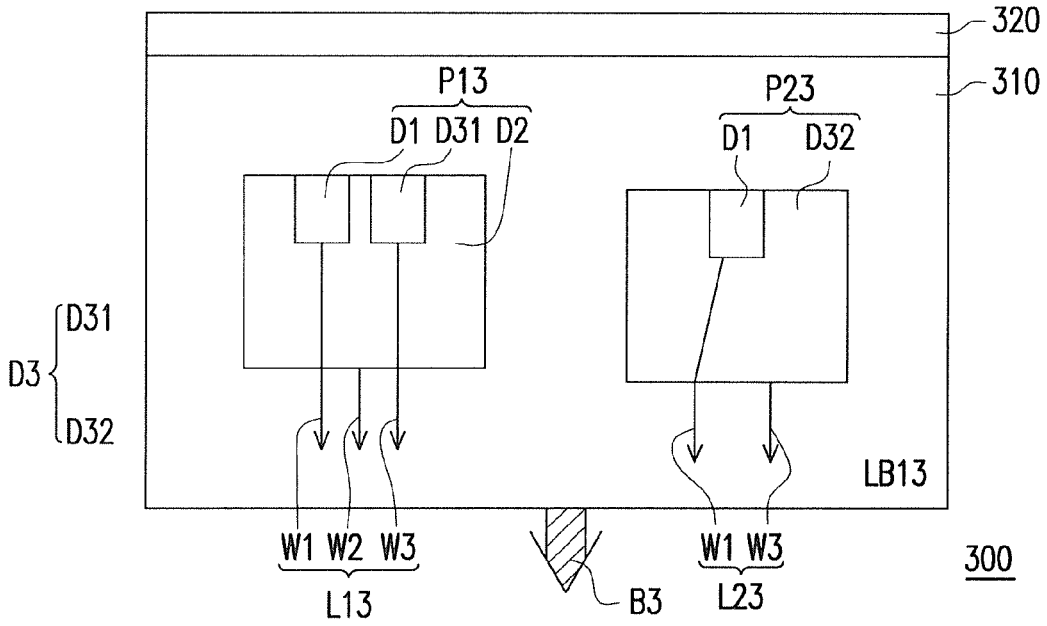
FIG. 4A is a schematic diagram of a light source apparatus in another embodiment of the disclosure.

FIG. 4A is a schematic diagram of a light source apparatus in another embodiment of the disclosure. Similarly to the embodiment of FIG. 2A, a light source apparatus 300 in FIG. 4A includes a first light-emitting unit D1, a second light-emitting unit D2 and a third light-emitting unit D3, in which the third light-emitting unit D3 includes two light-emitting units D31 and D32.

The first portion P1 of the light source apparatus 300 includes the first light-emitting unit D1, the second light-emitting unit D2 and the third light-emitting unit D31 respectively corresponding to producing the first sub-light beam W1, the second sub-light beam W2 and the third sub-light beam W3. The second sub-light beam W2 herein can be produced by a phosphor stimulated by the first sub-light beam W1 (at the time, the second light-emitting unit D2 can be a phosphor), while the third sub-light beam W3 is produced by a light-emitting diode (LED). The second portion P23 of the light source apparatus 300 includes the first light-emitting unit D1 and the third light-emitting unit D32 respectively corresponding to producing the first sub-light beam W1 and the third sub-light beam W3, in which the first sub-light beam W1 can be produced by an LED and the third sub-light beam W3 can be produced by a phosphor stimulated by the first sub-light beam W1 (at the time, the third light-emitting unit D32 can be a phosphor). Herein, at least one range of wave peaks of the first sub-light beam W1 is greater than 420 nm but less than 480 nm, at least one range of wave peaks of the second sub-light beam W2 can be greater than 480 nm but less than 540 nm, and at least one range of wave peaks of the third sub-light beam W3 can be greater than 540 nm.

In the embodiment of FIG. 4A, the difference from the above-mentioned embodiments rests in that, in the light source apparatus 300 of FIG. 4A, the control unit 320 makes the light B3 emitted from the light-emitting module 310 switched between a first light L13 and a second light L23, in which the color temperatures of the first light L13 and the second light L23 are different from each other.

Figure 4B:
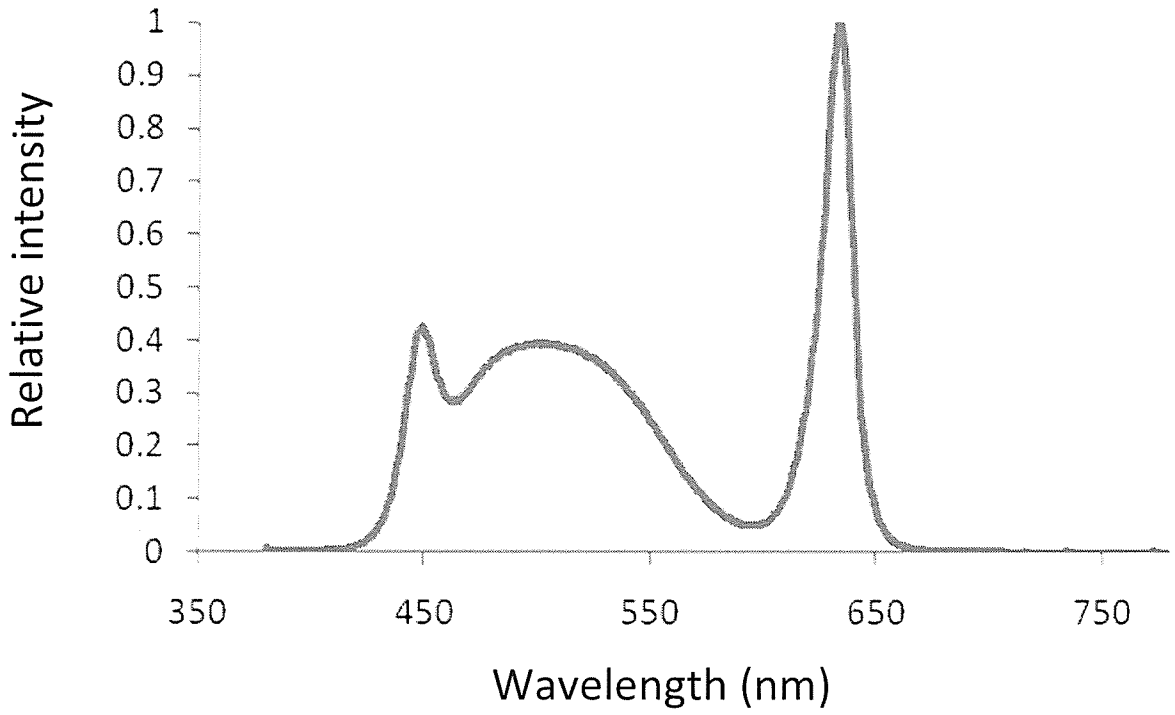
FIG. 4B is a diagram showing spectrum curve of the first light in the embodiment of FIG. 4A.
Figure 4C:
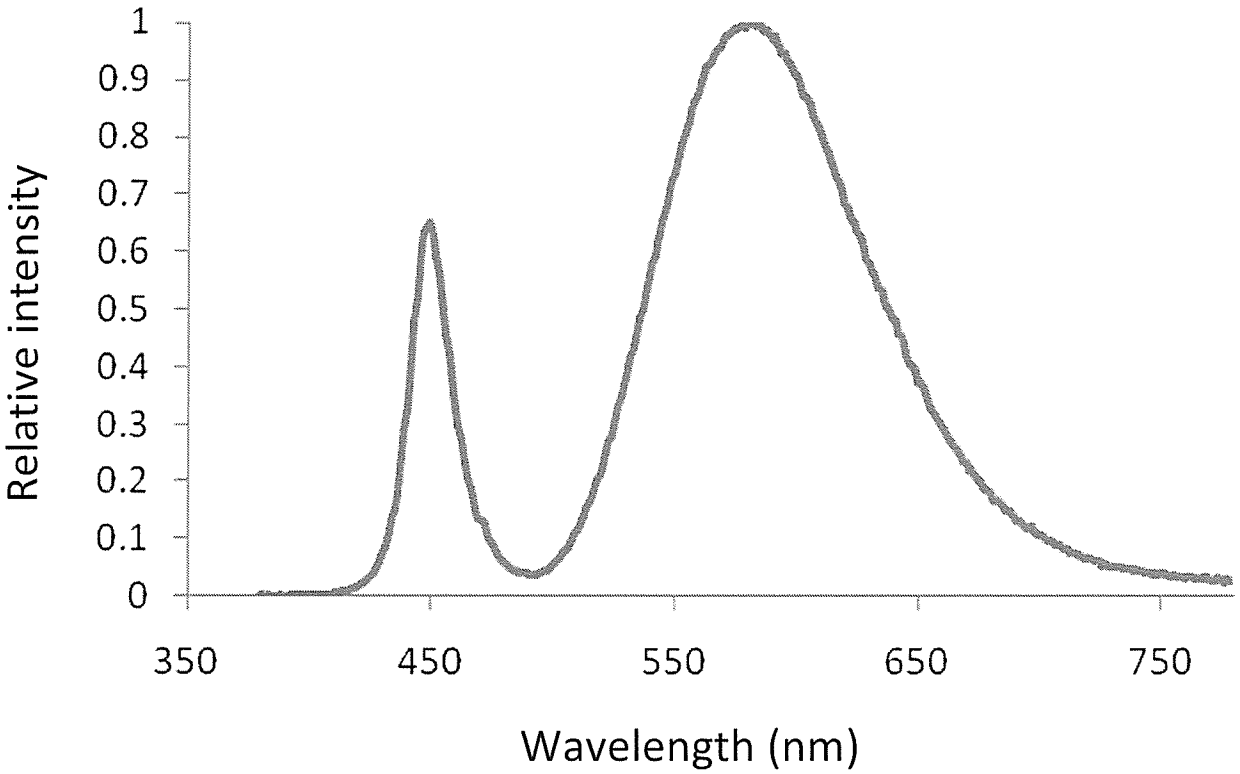
FIG. 4C is a diagram showing spectrum curve of the second light in the embodiment of FIG. 4A.

FIG. 4B is a diagram showing spectrum curve of the first light in the embodiment of FIG. 4A and FIG. 4C is a diagram showing spectrum curve of the second light in the embodiment of FIG. 4A. In the embodiment, the embodiment in FIG. 4B takes the color temperature of 6500K as an example, while the embodiment in FIG. 4C takes the color temperature of 3000K as an example. By the calculations on the spectrum curves in FIGS. 4B and 4C through the related formulas, the CS/P value of the first light L13 provided by the light-emitting module 310 of the light source apparatus 300 is roughly 0.94 and the CS/P value of the second light L23 is roughly 0.27. The CS/P value of the first light L13 herein is roughly 3.48 times of the CS/P value of the second light L23, i.e., the CS/P value of the first light L13 is greater than the CS/P value of the second light L23 by more than 5% of the CS/P value of the second light L23.

Figure 4D:
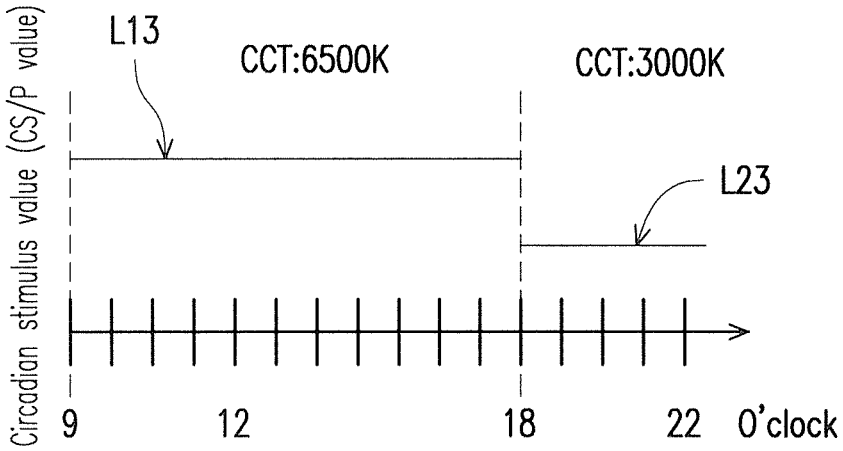
FIG. 4D is a timing diagram showing different illumination modes in different periods for the light source apparatus in the embodiment of FIG. 4A.

FIG. 4D is a timing diagram showing different illumination modes in different periods for the light source apparatus in the embodiment of FIG. 4A. The light source apparatus 300 of FIG. 4D can be used in resident lighting, as shown by FIG. 4D, the light-emitting module 310 of the light source apparatus 300 can provide a light source with a high CS/P value and high color temperature (6500K) in the daytime period (for example, 9:00-18:00) so as to make a person feel fresh and boost the vitality and a light source with a low CS/P value and low color temperature (3000K) in the evening period (for example, 18:00-22:00) so as to bring a person feeling of warmth and comfort. The above-mentioned CS/P values and the spectrum curves in FIGS. 4B and 4C herein are examples used in the embodiment only, and they may be different in other embodiments according to the real requirement, which the disclosure is not limited to.

Figure 5A:
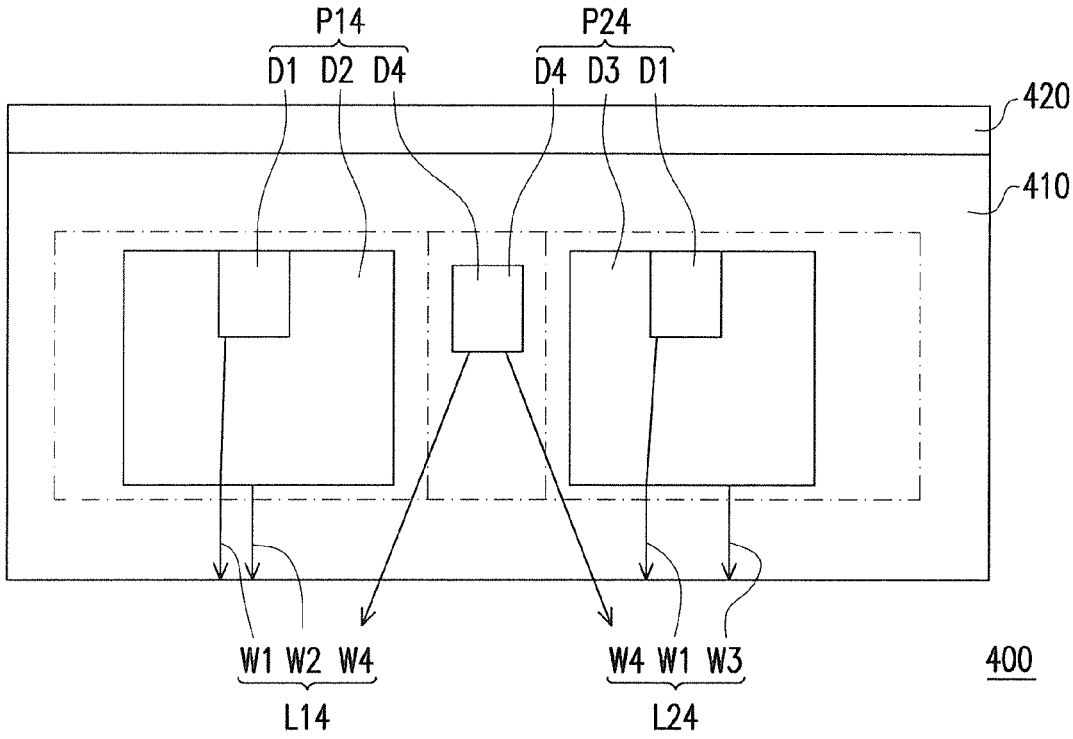
FIG. 5A is a schematic diagram of a light source apparatus in yet another embodiment of the disclosure.

FIG. 5A is a schematic diagram of a light source apparatus in yet another embodiment of the disclosure. The light source apparatus in FIG. 5A is similar to the embodiment in FIG. 2A, except that in the embodiment, a light-emitting module 410 further includes at least one fourth light-emitting unit D4, in which the first light-emitting unit D1 provides a first sub-light beam W1, the second light-emitting unit D2 provides a second sub-light beam W2, the third light-emitting unit D3 provides a third sub-light beam W3 and the fourth light-emitting unit D4 provides a fourth sub-light beam W4. As shown by FIG. 5A, the first portion P14 can include the first light-emitting unit D1, the second light-emitting unit D2 and the fourth light-emitting unit D4; the second portion P24 can include the first light-emitting unit D1, the third light-emitting unit D3 and the fourth light-emitting unit D4. When the control unit 420 makes the light-emitting module 410 switched to the first circadian stimulus mode, the first light-emitting unit D1 emits the first sub-light beam W1, the second light-emitting unit D2 emits the second sub-light beam W2 and the fourth light-emitting unit D4 emits the fourth sub-light beam W4; when the control unit 420 makes the light-emitting module 410 switched to the second circadian stimulus mode, the first light-emitting unit D1 emits the first sub-light beam W1, the third light-emitting unit D3 emits the third sub-light beam W3 and the fourth light-emitting unit D4 emits the fourth sub-light beam W4. The CS/P value of the first sub-light beam W1 herein is greater than the CS/P value of the second sub-light beam W2, and the CS/P value of the second sub-light beam W2 is greater than the CS/P value of the third sub-light beam W3. In short, under the first circadian stimulus mode, the first light L14 provided by the light-emitting module 410 of the light source apparatus 400 can include the first sub-light beam W1, the second sub-light beam W2 and the fourth sub-light beam W4; under the second circadian stimulus mode, the second light L24 provided by the light-emitting module 410 of the light source apparatus 400 can include the first sub-light beam W1, the third sub-light beam W3 and the fourth sub-light beam W4 so as to achieve the similar effect to the light source apparatus 100 in the embodiment of FIG. 2A.

In other words, the light-emitting module 410 of the light source apparatus 400 can include the first light-emitting unit D1, the second light-emitting unit D2, the third light-emitting unit D3 and the fourth light-emitting unit D4, in which at least the first light-emitting unit D1, the second light-emitting unit D2 and the fourth light-emitting unit D4 can form the first light source (i.e., the first portion P14) to emit the first light L14, and the first light-emitting unit D1, the third light-emitting unit D3 and the fourth light-emitting unit D4 can form the second light source (i.e., the second portion P24) to emit the second light L24. The color temperatures of the first light L14 and the second light L24 emitted from the first light source and the second light source are substantially the same, but the first light L14 and the second light L24 have different CS/P values.

In the embodiment, the first light-emitting unit D1 in FIG. 5A can be an LED, the second sub-light beam W2 can be produced by a first phosphor stimulated by the first sub-light beam W1 and the third sub-light beam W3 can be produced by a second phosphor stimulated by the first sub-light beam W1; that is to say, in the embodiment, the second light-emitting unit D2 and the third light-emitting unit D3 are made of electroluminescent light-emitting material (such as phosphor material), which can be stimulated by the first sub-light beam W1 to produce the second sub-light beam W2 and the third sub-light beam W3 with different ranges of wave peaks from each other. In addition, in the embodiment, the fourth light-emitting unit D4 can be, for example, an LED, but in other embodiments, the fourth light-emitting unit D4 may be made of electroluminescent light-emitting material (such as phosphor material) stimulated by light to produce the fourth sub-light beam W4, which the disclosure is not limited to. In another embodiment, the first light-emitting unit D1, the second light-emitting unit D2, the third light-emitting unit D3 and the fourth light-emitting unit D4 can be an LED or a combination of LED and phosphor with different ranges of wave peaks.

Figure 5B:
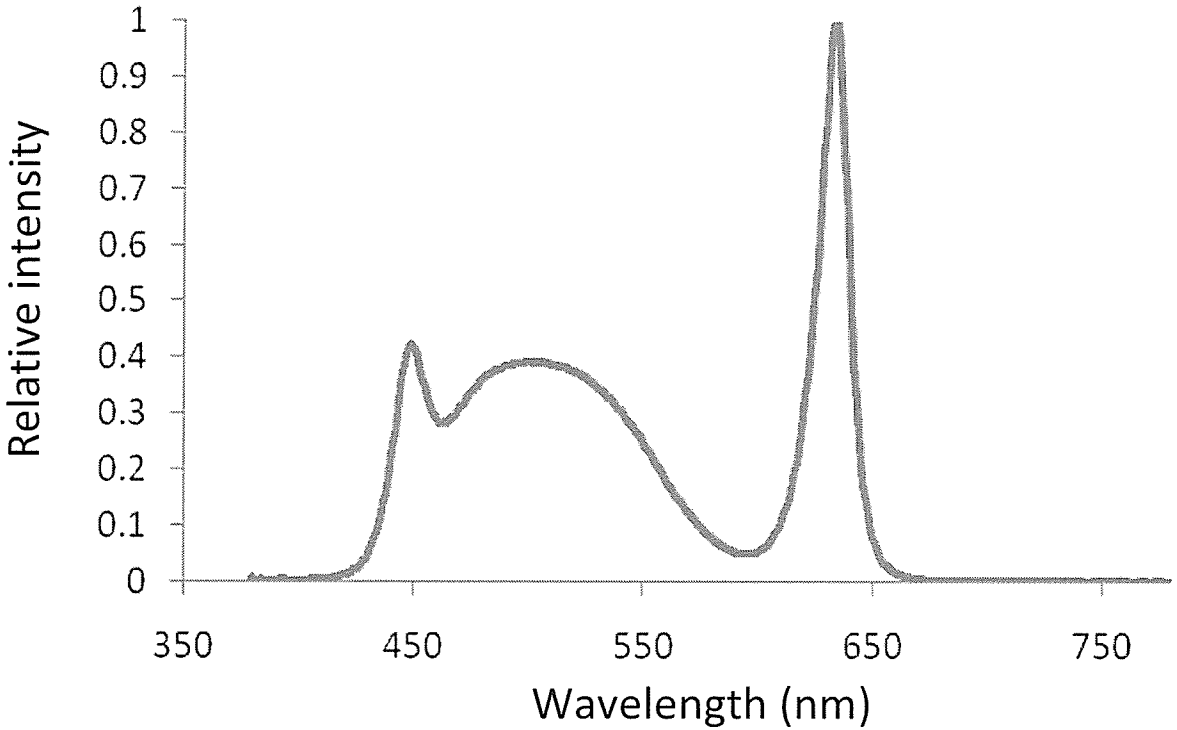
FIG. 5B is a diagram showing spectrum curve of the first light in the embodiment of FIG. 5A.
Figure 5C:
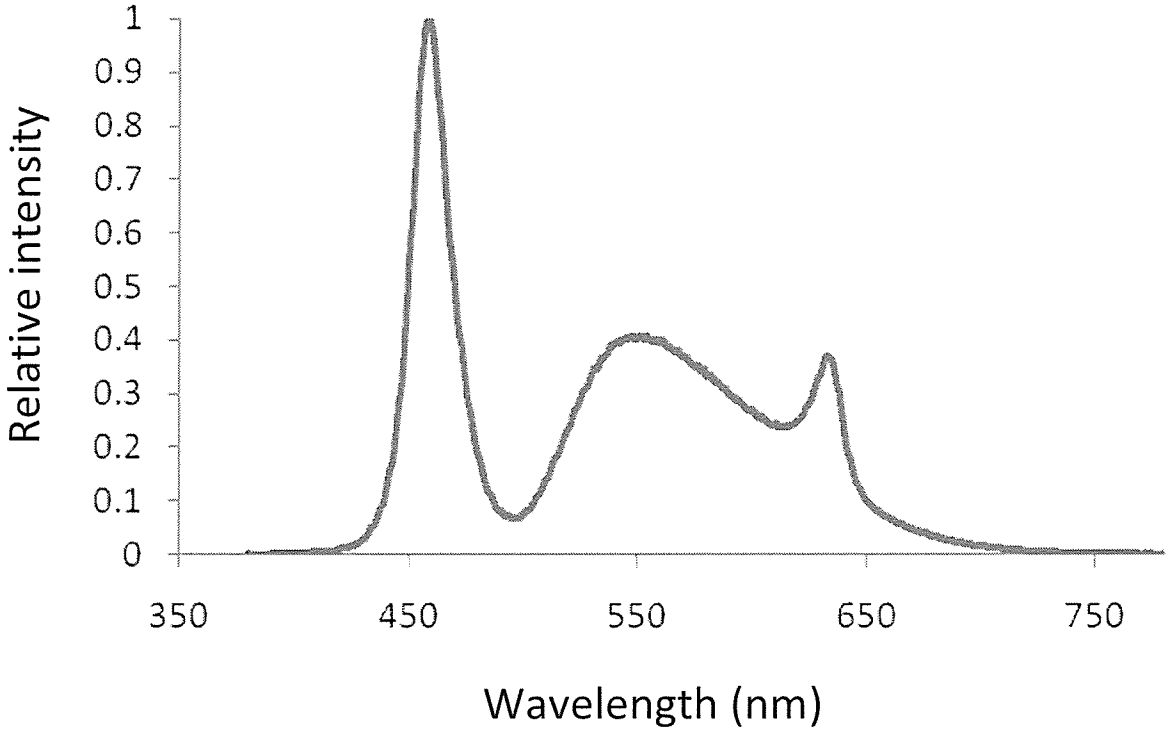
FIG. 5C is a diagram showing spectrum curve of the second light in the embodiment of FIG. 5A.
Figure 5D:
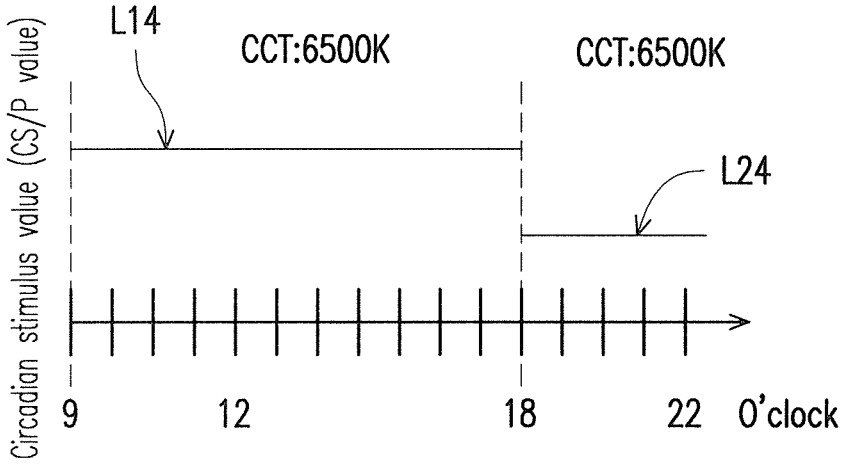
FIG. 5D is a timing diagram showing different illumination modes in different periods for the light source apparatus in the embodiment of FIG. 5A.

FIG. 5B is a diagram showing spectrum curve of the first light in the embodiment of FIG. 5A, FIG. 5C is a diagram showing spectrum curve of the second light in the embodiment of FIG. 5A and FIG. 5D is a timing diagram showing different illumination modes in different periods for the light source apparatus in the embodiment of FIG. 5A. In more details, at least one range of wave peaks of the first sub-light beam W1 is greater than 420 nm but less than 480 nm, at least one range of wave peaks of the second sub-light beam W2 is greater than 480 nm but less than 540 nm, at least one range of wave peaks of the third sub-light beam W3 is greater than 540 nm but less than 590 nm and at least one range of wave peaks of the fourth sub-light beam W4 is greater than 590 nm but less than 680 nm. When the light source apparatus 400 is in the first circadian stimulus mode, the spectrum of the first light L14 provided by the light-emitting module 410 is shown by the light-blending spectrum curve in FIG. 5B; when the light source apparatus 400 is in the second circadian stimulus mode, the light-blending spectrum of the second light L24 provided by the light-emitting module 410 is shown by the spectrum curve in FIG. 5C. In the embodiment, the color temperatures in FIGS. 5B and 5C are, for example, 6500K. According to the spectrum curves in FIGS. 5B and 5C, it can be deduced the CS/P value of the first light L14 provided by the light source apparatus 400 is roughly 0.94 and the CS/P value of the second light L24 is roughly 0.79. Thus, the light source apparatus 400 can be used in working illumination (such as hospital or factory illumination) as shown by FIG. 5D. The light-emitting module 410 of the light source apparatus 400 can provide a light source with high CS/P value and high color temperature in daytime period (for example, 9:00-18:00) so as to make stuff feel fresh and boost the vitality, provide a light source with low CS/P value but high color temperature in evening period (for example, 18:00-22:00) so as to reduce the circadian stimulus on the stuff on evening duty so as to avoid affecting the health of the stuff. It should be noted that the spectrum curves in FIGS. 5B and 5C are used to describe the embodiment only; in other embodiments, it can be different according to the real requirement, which the disclosure is not limited to. The light source apparatus 400 in FIG. 5A can, similarly to the light source apparatus 300 in the embodiment of FIG. 4A, provide the first light L14 and the second light L24 with different color temperatures and different CS/P values with difference over 5% by adjusting the proportions between the first sub-light beam W1, the second sub-light beam W2, the third sub-light beam W3 and the fourth sub-light beam W4, which can refer to the embodiments of FIGS. 2A and 4A and is omitted to describe.

Figure 6A:
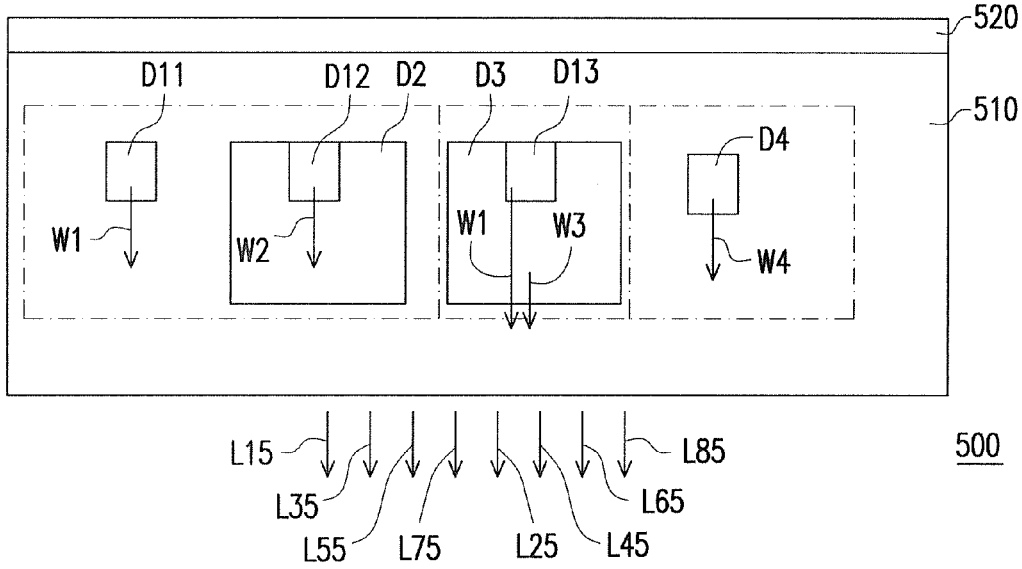
FIG. 6A is a schematic diagram of a light source apparatus in yet another embodiment of the disclosure.
Figure 6B:
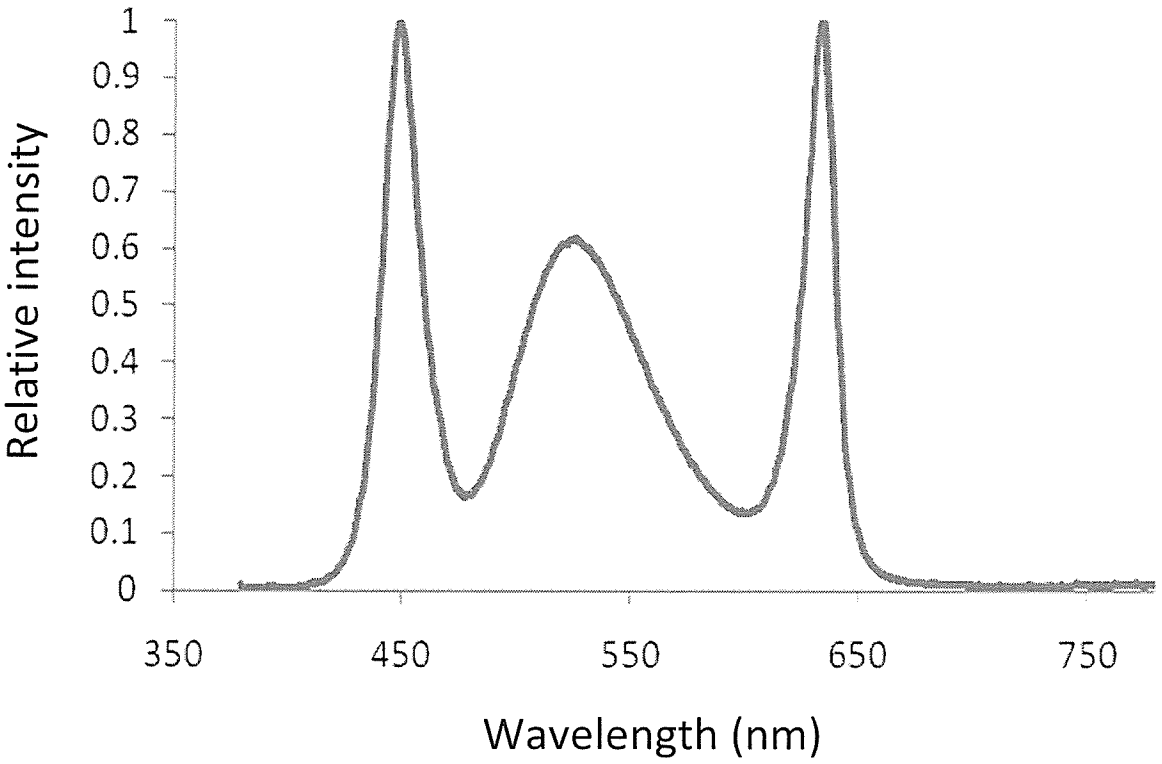
FIGS. 6B-6I are diagrams showing spectrum curves of the lights provided by the light source apparatus 500 under various color temperature conditions.
Figure 6C:
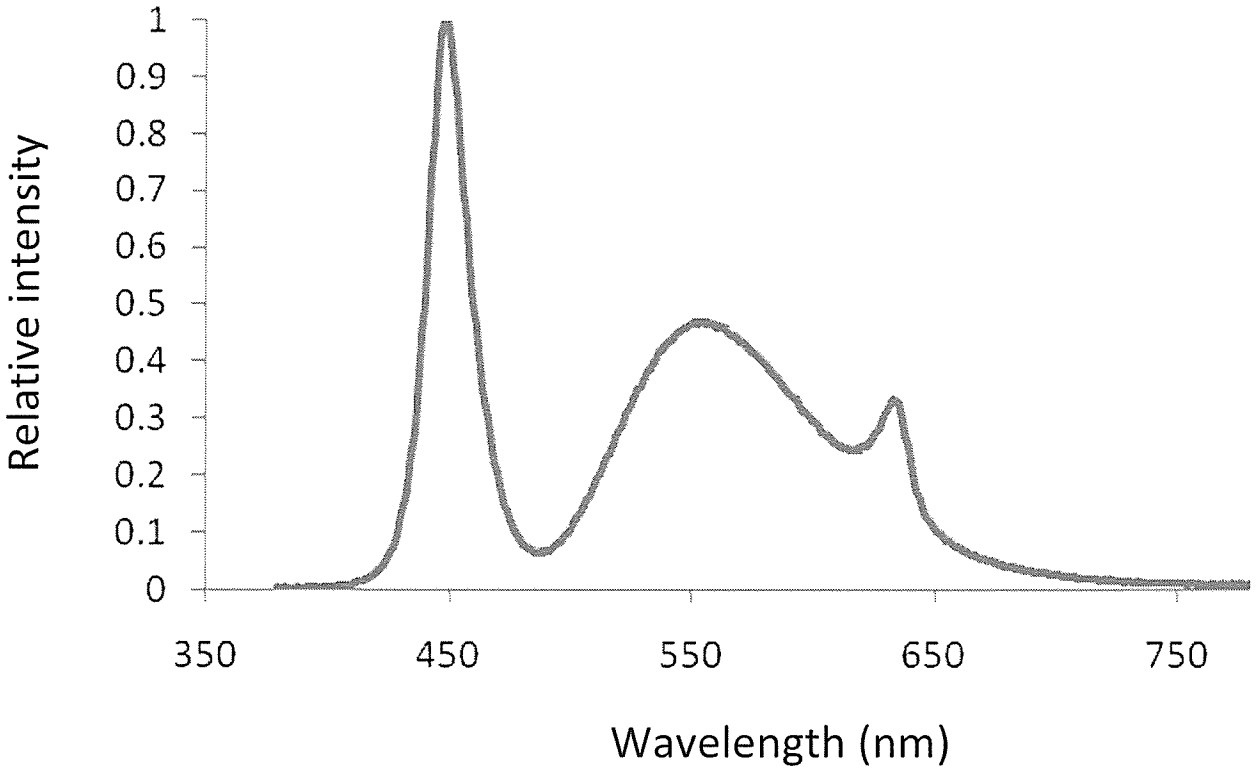
Figure 6D:
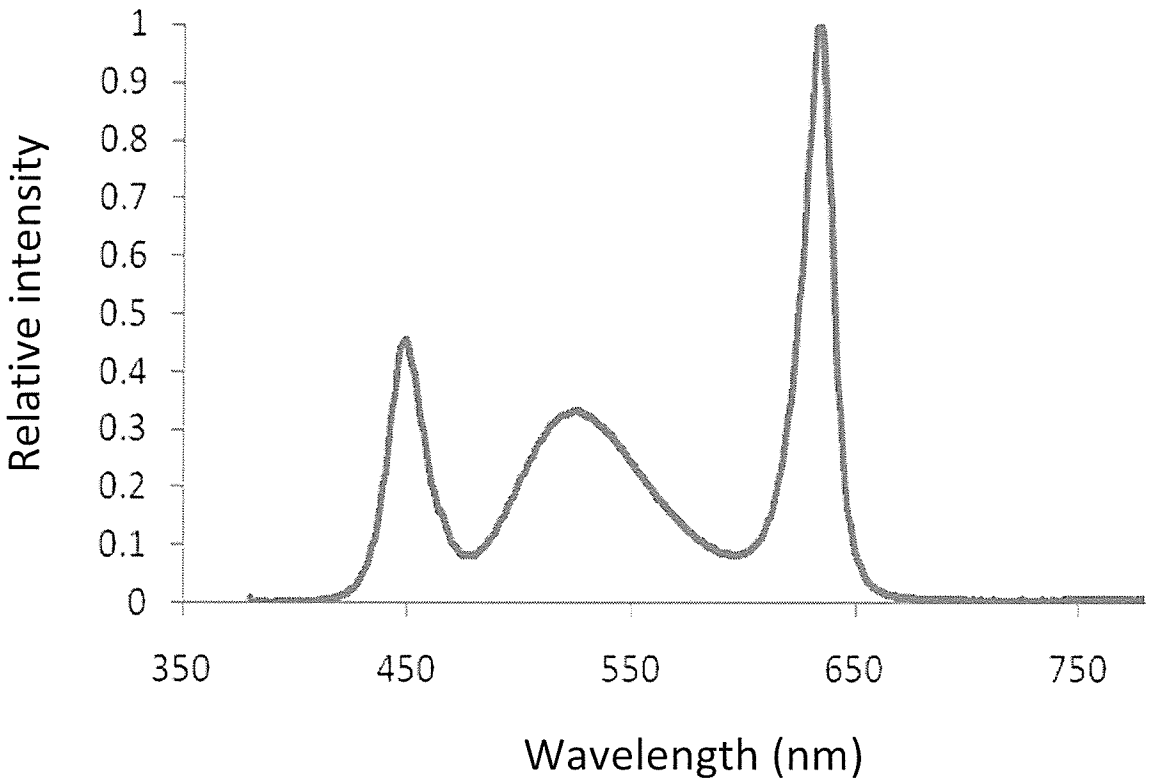
Figure 6E:
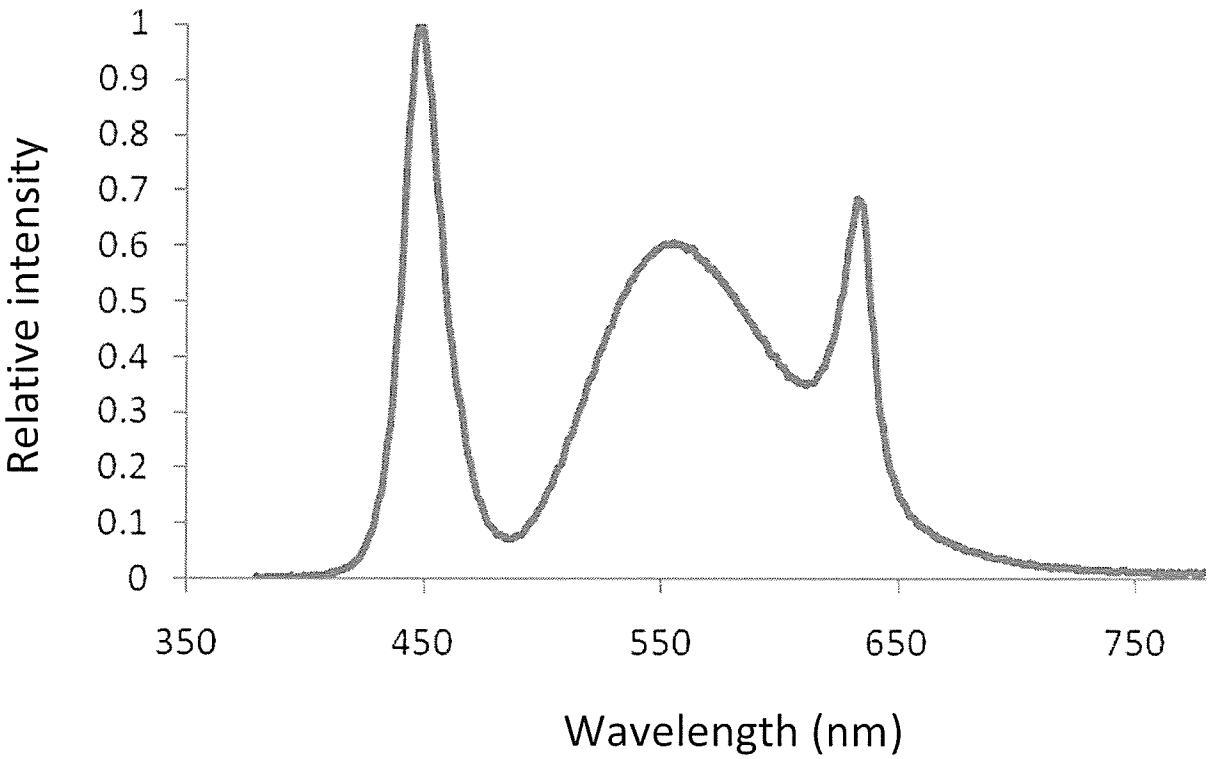
Figure 6F:
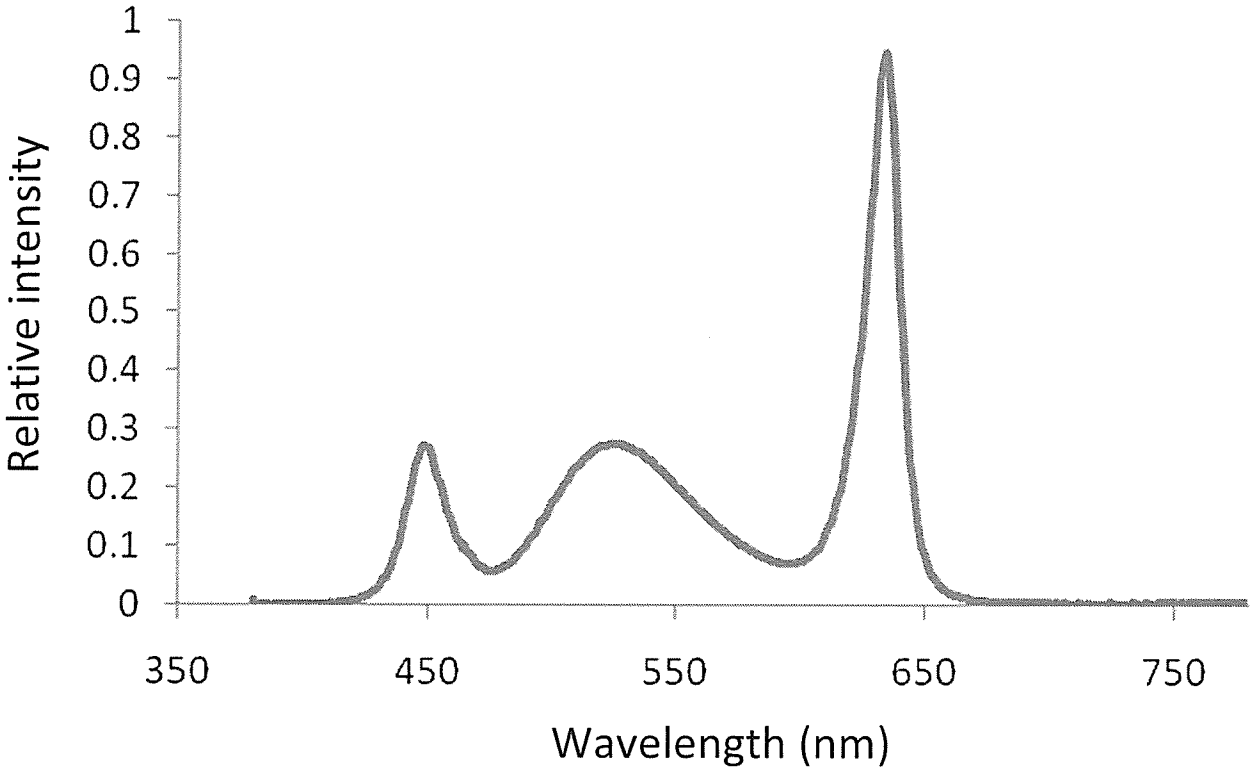
Figure 6G:
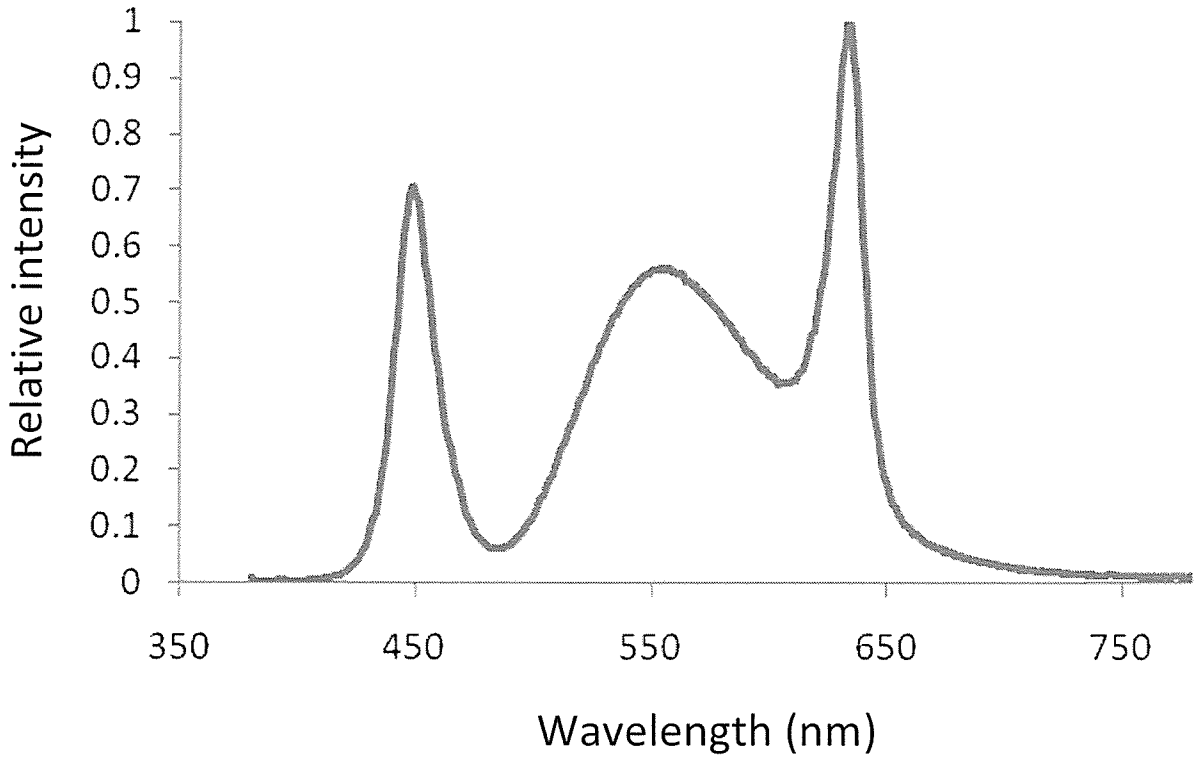
Figure 6H:
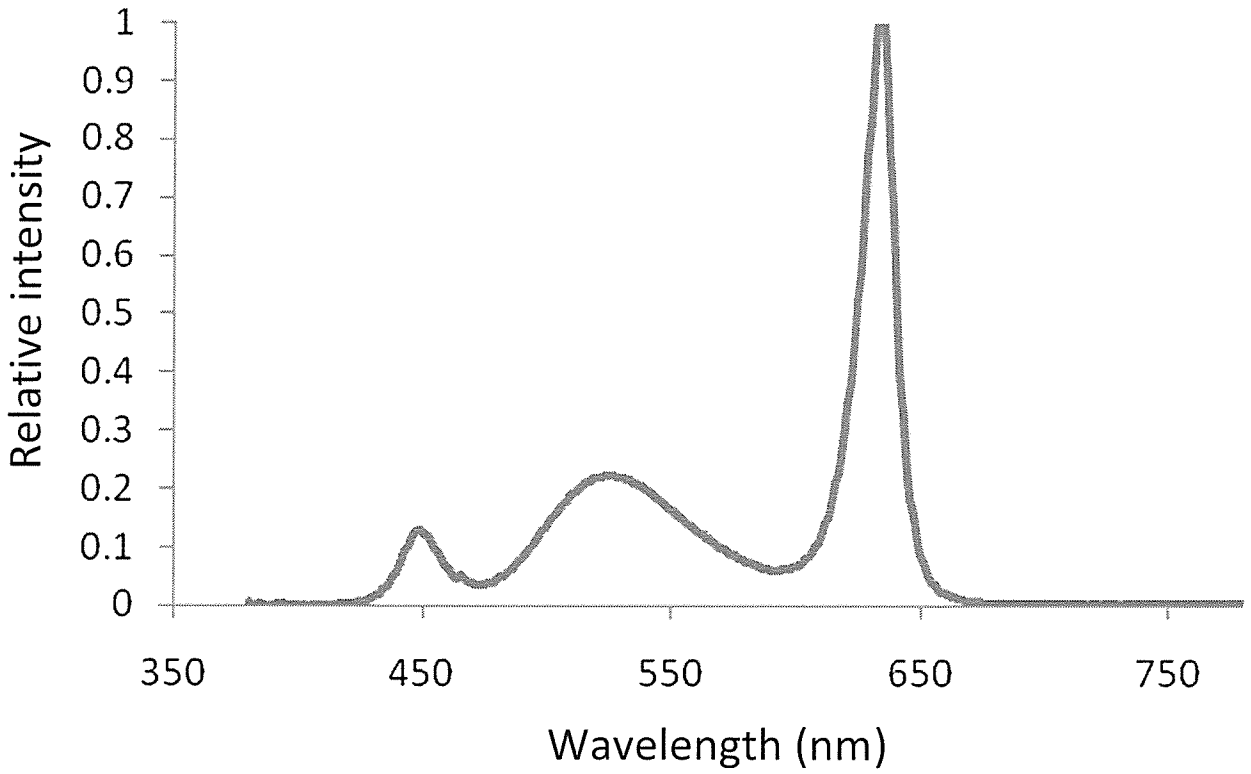
Figure 6I:
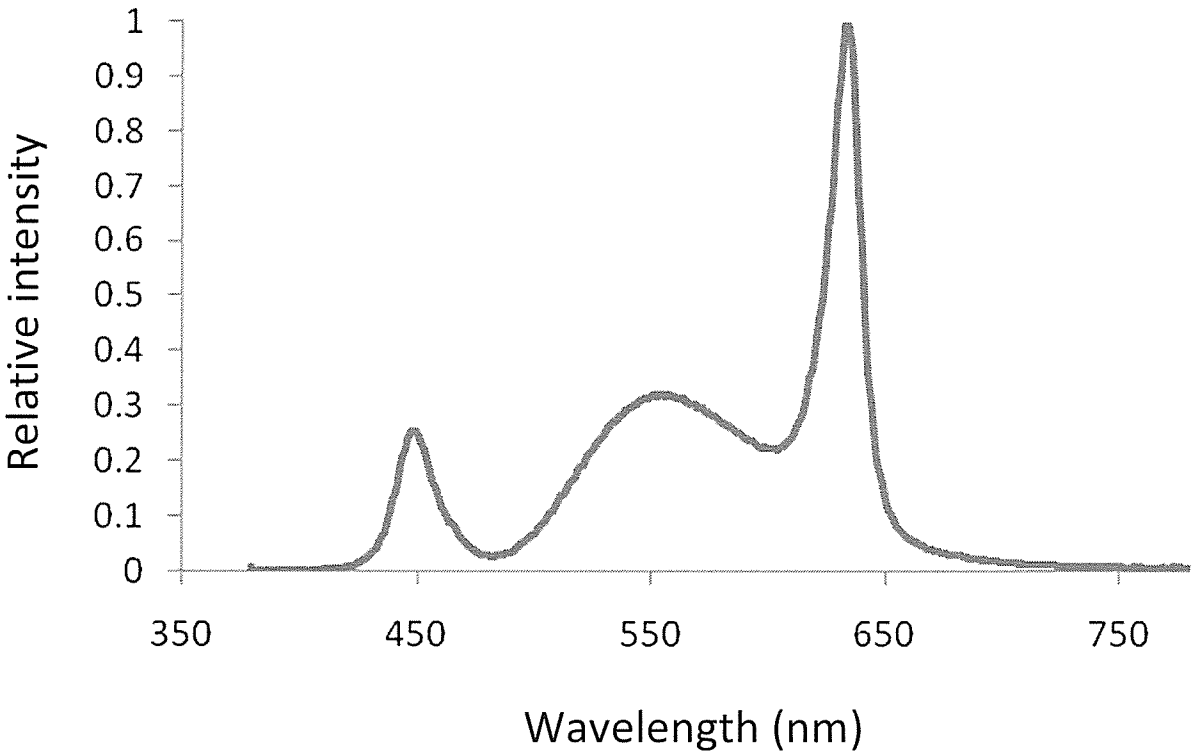

FIG. 6A is a schematic diagram of a light source apparatus in yet another embodiment of the disclosure and FIGS. 6B-6I are diagrams showing spectrum curves of the lights provided by the light source apparatus 500 under various color temperature conditions. The light source apparatus in FIG. 6A is similar to the embodiment in FIG. 5A and there are the first sub-light beam W1, the second sub-light beam W2, the third sub-light beam W3 and the fourth sub-light beam W4 all which have the same range of wave peaks, except that in the embodiment of FIG. 6A, the light-emitting module 510 of the light source apparatus 500 can provide more sets of light sources with different color temperatures and high/low CS/P values under these illumination modes. For example, in the embodiment, when the first light-emitting units D11 and D12 in the light-emitting module 510 of the light source apparatus 500 provide first sub-light beams W1, the second light-emitting unit D2 provides the second sub-light beam W2 and the fourth light-emitting unit D4 provides the fourth sub-light beam W4, the light-emitting module 510 of the light source apparatus 500 can respectively provide lights with higher CS/P values, i.e., a first light L15 (for example, 6500K and 0.82 of CS/P value), a third light L35 (for example, 5000K and 0.67 of CS/P value), a fifth light L55 (for example, 4000K and 0.54 of CS/P value) and a seventh light L75 (for example, 3000K and 0.39 of CS/P value) according to the application requirement by adjusting the proportions between the first sub-light beam W1, the second sub-light beam W2 and the fourth sub-light beam W4; on the other hand, when the first light-emitting units D11 and D13 in the light-emitting module 510 of the light source apparatus 500 provide first sub-light beams W1, the third light-emitting unit D3 provides the third sub-light beam W3 and the fourth light-emitting unit D4 provides the fourth sub-light beam W4, the light-emitting module 510 of the light source apparatus 500 can respectively provide lights with lower CS/P values, i.e., a second light L25 (6500K and 0.72 of CS/P value), a fourth light L45 (5000K and 0.57 of CS/P value), a sixth light L65 (4000K and 0.45 of CS/P value) and an eighth light L85 (3000K and 0.30 of CS/P value) according to the application requirement by adjusting the proportions between the first sub-light beam W1, the third sub-light beam W3 and the fourth sub-light beam W4. Thus, in comparison with the light-emitting modules 110 and 110' of the light source apparatuses 100 and 100' in FIGS. 2A and 2C, the light-emitting module 510 of the light source apparatus 500 of the embodiment can provide more sets of light sources with different color temperatures so as to meet various application requirements and have good application potential.

In more details, in the embodiment, the light source apparatus 500 can include a first circadian stimulus mode, a second circadian stimulus mode, a third circadian stimulus mode, a fourth circadian stimulus mode, a fifth circadian stimulus mode, a sixth circadian stimulus mode, a seventh circadian stimulus mode and an eighth circadian stimulus mode. The control unit 520 makes the lights emitted by the light-emitting module 510 under these circadian stimulus modes respectively switched between the first light L15 (corresponding to the spectrum curve shown by FIG. 6B), the second light L25 (corresponding to the spectrum curve shown by FIG. 6C), the third light L35 (corresponding to the spectrum curve shown by FIG. 6D), the fourth light L45 (corresponding to the spectrum curve shown by FIG. 6E), the fifth light L55 (corresponding to the spectrum curve shown by FIG. 6F), the sixth light L65 (corresponding to the spectrum curve shown by FIG. 6G), the seventh light L75 (corresponding to the spectrum curve shown by FIG. 6H) and the eighth light L85 (corresponding to the spectrum curve shown by FIG. 6I) so as to provide more sets of light sources.

In more details, the CS/P value of the second light L25 is less than the CS/P value of the first light L15 and the color temperatures of the second light L25 and the first light L15 are substantially the same; the CS/P value of the fourth light L45 is less than the CS/P value of the third light L35 and the color temperatures of the fourth light L45 and the third light L35 are substantially the same; the CS/P value of the sixth light L65 is less than the CS/P value of the fifth light L55 and the color temperatures of the sixth light L65 and the fifth light L55 are substantially the same; the CS/P value of the eighth light L85 is less than the CS/P value of the seventh light L75 and the color temperatures of the eighth light L85 and the seventh light L75 are substantially the same. The color temperatures of the first light L15, the third light L35, the fifth light L55 and the seventh light L75 are substantially different, and the color temperatures of the second light L25, the fourth light L45, the sixth light L65 and the eighth light L85 are substantially different. In other words, the light-emitting module 510 of the light source apparatus 500 can provide more sets of light sources with different color temperatures by adjusting the proportions between the first sub-light beam W1, the second sub-light beam W2, the third sub-light beam W3 and the fourth sub-light beam W4. Specifically, the lights with the same color temperature of each of the sets can be switched between a high CS/P value and a low CS/P value.

Moreover, in the embodiment, the light-emitting module 510 of the light source apparatus 500 can include three first light-emitting units D11, D12 and D13, a second light-emitting unit D2, a third light-emitting unit D3 and a fourth light-emitting unit D4, in which the first light-emitting units D11 and D12, the second light-emitting unit D2 and the fourth light-emitting unit D4 form a first light source (i.e., the first portion P1) to emit the first light L15, the third light L35, the fifth light L55 and the seventh light L75 respectively under each of the circadian stimulus modes. On the other hand, the first light-emitting units D11 and D13, the third light-emitting unit D3 and the fourth light-emitting unit D4 form a second light source (i.e., the second portion P2) to emit the second light L25, the fourth light L45, the sixth light L65 and the eighth light L85 under each of the circadian stimulus modes.

In this way, by changing the light-blending proportions between the first sub-light beam W1, the second sub-light beam W2, the third sub-light beam W3 and the fourth sub-light beam W4, the light source apparatus 500 can, under the color temperature condition of 6500K, make the light switched between the first light L15 with high CS/P value and the second light L25 with low CS/P value; the light source apparatus 500 can, under the color temperature condition of 5000K, make the light switched between the third light L35 with high CS/P value and the fourth light L45 with low CS/P value; the light source apparatus 500 can, under the color temperature condition of 4000K, make the light switched between the fifth light L55 with high CS/P value and the sixth light L65 with low CS/P value; the light source apparatus 500 can, under the color temperature condition of 3000K, make the light switched between the seventh light L75 with high CS/P value and the eighth light L85 with low CS/P value. As a result, the light source apparatus 500 has larger application potential.

The first light L15 and the second light L25 have the same color temperature but different CS/P values, the third light L35 and the fourth light L45 have the same color temperature but different CS/P values, the fifth light L55 and the sixth light L65 have the same color temperature but different CS/P values, and the seventh light L75 and the eighth light L85 have the same color temperature but different CS/P values. In other embodiments however, the first light L15 and the second light L25 can have different color temperatures, and the CS/P value of the first light L15 is greater than the CS/P value of the second light L25 by over 5% of the CS/P value of the second light L25; the third light L35 and the fourth light L45 have different color temperatures, and the CS/P value of the third light L35 is greater than the CS/P value of the fourth light L45 by over 5% of the CS/P value of the fourth light L45; the fifth light L55 and the sixth light L65 have different color temperatures, and the CS/P value of the fifth light L55 is greater than the CS/P value of the sixth light L65 by over 5% of the CS/P value of the sixth light L65; the seventh light L75 and the eighth light L85 have different color temperatures, and the CS/P value of the seventh light L75 is greater than the CS/P value of the eighth light L85 by over 5% of the CS/P value of the eighth light L85. In this way, it has the effect same as the light source apparatus 500 in FIG. 6A.

Figure 6J:
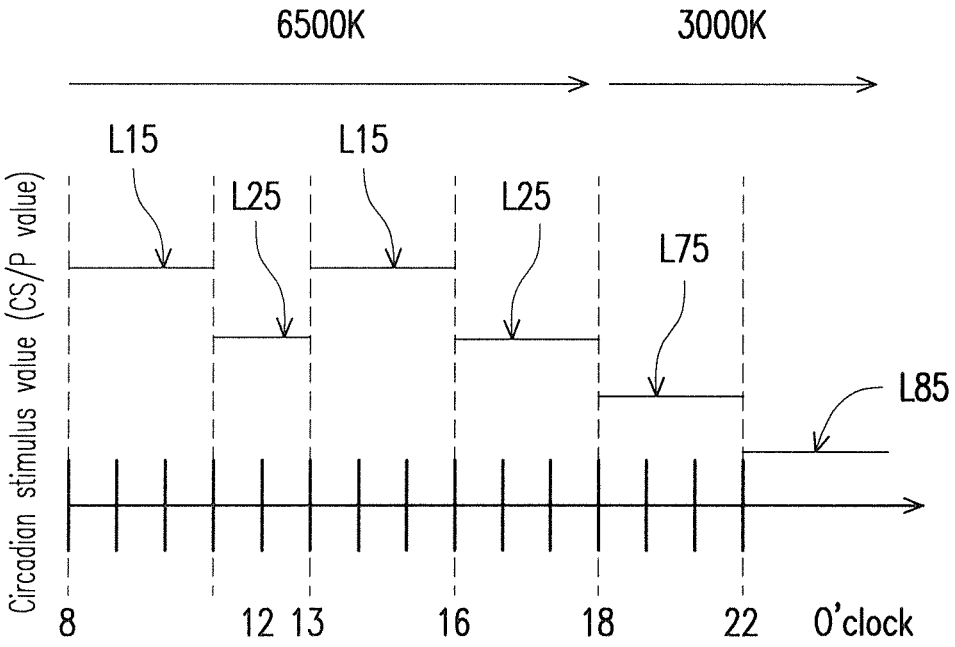
FIG. 6J is a timing diagram showing different illumination modes in different periods for the light source apparatus in the embodiment of FIG. 6A.

FIG. 6J is a timing diagram showing different illumination modes in different periods for the light source apparatus in the embodiment of FIG. 6A. Referring to FIG. 6J, the light source apparatus 500, for example, is used in office illumination, in which the light source apparatus 500 in the daytime period (8:00-11:00 as shown by FIG. 6J) can be switched to the first circadian stimulus mode to make the light-emitting module 510 provide the first light L15 with high color temperature (6500K) and high CS/P value; in the lunch break period (11:00-13:00), the light source apparatus 500 is switched to the second circadian stimulus mode to make the light-emitting module 510 provide the second light L25 with high color temperature and low CS/P value so as to reduce the circadian stimulus on the stuff during rest; in the afternoon period after the lunch break (13:00-16:00), the light source apparatus 500 is switched back to the first circadian stimulus mode to advance the working efficiency; in the evening period after off work (after 18:00 as shown by FIG. 6J), the light source apparatus 500 is switched to the seventh circadian stimulus mode to make the light-emitting module 510 provide the seventh light L75 with low color temperature (3000K); in the sleeping night period (after 22:00 as shown by FIG. 6J), the light source apparatus 500 is switched to the eighth circadian stimulus mode to make the light-emitting module 510 provide the eight light L85 with low color temperature (3000K) and the lowest CS/P value. In addition, the light source apparatus 500 can provide more combinations of light sources for more wide applications.

In summary, the light source apparatus in the embodiments of the disclosure can use the control unit to control the light-emitting module for providing lights with the same color temperature and different CS/P values. The light-emitting module can also provide lights with a plurality of sets of color temperatures through a plurality of sets of light-emitting units, and the light of each set of the same color temperatures can be switched between different lights with different CS/P values. In addition, the light source apparatus in the embodiments of the disclosure can provide lights with over 5% difference of CS/P values by controlling the light-emitting module through the control unit, in which the lights can have totally different color temperatures, or a part of the lights has the same color temperature. In this way, the light source apparatus can select light sources with different CS/P values according to the real application environment, the time and the goal so as to maintain the natural circadian rhythm of the user and meanwhile provide enough light sources. The light source apparatus of the disclosure can serve as an illumination device or a backlight device of a display, which the disclosure is not limited to.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A light source apparatus, comprising:

a light-emitting module, for providing a light; and a control unit, making the light emitted from the light-emitting module switched between a first light and a second light, wherein a circadian stimulus value of the second light is less than a circadian stimulus value of the first light, and color temperatures of the second light and the first light are substantially the same as each other.

2. The light source apparatus as claimed in claim 1, wherein the control unit makes the light-emitting module switched between a plurality of illumination modes, the illumination modes comprise a first circadian stimulus mode and a second circadian stimulus mode, the light-emitting module comprises a plurality of light-emitting units, when the control unit switches the light-emitting module to the first circadian stimulus mode, the control unit makes a first portion of the light-emitting units emit light and when the control unit switches the light-emitting module to the second circadian stimulus mode, the control unit makes a second portion of the light-emitting units emit light, wherein the first portion and the second portion are partially the same as each other or totally different from each other.

3. The light source apparatus as claimed in claim 2, wherein the light-emitting units comprise electroluminescent light-emitting element, light-induced light-emitting element or a combination thereof.

4. The light source apparatus as claimed in claim 3, wherein the light-emitting module comprises at least one first light-emitting unit, at least one second light-emitting unit and at least one third light-emitting unit, the first light-emitting unit provides a first sub-light beam, the second light-emitting unit provides a second sub-light beam and the third light-emitting unit provides a third sub-light beam, the first portion at least comprises the first light-emitting unit and the second light-emitting unit, the second portion at least comprises the first light-emitting unit and the third light-emitting unit, when the control unit switches the light-emitting module to the first circadian stimulus mode, the light-emitting units emits the first sub-light beam and the second light-emitting unit emits the second sub-light beam, and when the control unit switches the light-emitting module to the second circadian stimulus mode, the first light-emitting unit emits the first sub-light beam and the third light-emitting unit emits the third sub-light beam, wherein the circadian stimulus value of the second sub-light beam is greater than the circadian stimulus value of the third sub-light beam.

5. The light source apparatus as claimed in claim 4, wherein at least one range of wave peaks of the first sub-light beam is greater than 420 nm but less than 480 nm, at least one range of wave peaks of the second sub-light beam is greater than 480 nm but less than 540 nm and at least one range of wave peaks of the third sub-light beam is greater than 540 nm.

6. The light source apparatus as claimed in claim 5, wherein the first portion further comprises the third light-emitting unit, and if the illumination modes is switched to the first circadian stimulus mode, the third light-emitting unit emits the third sub-light beam.

7. The light source apparatus as claimed in claim 6, wherein the second light-emitting unit is a first phosphor, the third light-emitting unit is a second phosphor, the second sub-light beam can be produced by the first phosphor stimulated by the first sub-light beam and the third sub-light beam can be produced by the second phosphor stimulated by the first sub-light beam.

8. The light source apparatus as claimed in claim 4, wherein the light-emitting module further comprises at least one fourth light-emitting unit, the fourth light-emitting unit provides a fourth sub-light beam, the first portion comprises the first light-emitting unit, the second light-emitting unit and the fourth light-emitting unit and the second portion comprises the first light-emitting unit, the third light-emitting unit and the fourth light-emitting unit, when the control unit switches the light-emitting module to the first circadian stimulus mode, the first light-emitting unit emits the first sub-light beam, the second light-emitting unit emits the second sub-light beam and the fourth light-emitting unit emits the fourth sub-light beam, and when the control unit switches the light-emitting module to the second circadian stimulus mode, the first light-emitting unit emits the first sub-light beam, the third light-emitting unit emits the third sub-light beam and the fourth light-emitting unit emits the fourth sub-light beam, wherein the circadian stimulus value of the first sub-light beam is greater than the circadian stimulus value of the second sub-light beam and the circadian stimulus value of the second sub-light beam is greater than the circadian stimulus value of the third sub-light beam.

9. The light source apparatus as claimed in claim 8, wherein at least one range of wave peaks of the first sub-light beam is greater than 420 nm but less than 480 nm, at least one range of wave peaks of the second sub-light beam is greater than 480 nm but less than 540 nm, at least one range of wave peaks of the third sub-light beam is greater than 540 nm but less than 590 nm and at least one range of wave peaks of the fourth sub-light beam is greater than 590 nm but less than 680 nm.

10. The light source apparatus as claimed in claim 9, wherein the second light-emitting unit is a first phosphor, the third light-emitting unit is a second phosphor, the second sub-light beam can be produced by the first phosphor stimulated by the first sub-light beam and the third sub-light beam can be produced by the second phosphor stimulated by the first sub-light beam.

11. The light source apparatus as claimed in claim 8, wherein the control unit makes the light emitted from the light-emitting module switched between the first light, the second light, a third light and a fourth light, wherein a circadian stimulus value of the fourth light is less than a circadian stimulus value of the third light, and color temperatures of the fourth light and the third light are substantially the same as each other and the color temperatures of the first light and the third light are substantially different from each other.

12. The light source apparatus as claimed in claim 11, wherein the illumination modes further comprise a third circadian stimulus mode and a fourth circadian stimulus mode, when the control unit switches the light-emitting module to the third circadian stimulus mode, the first light-emitting unit emits the first sub-light beam, the second light-emitting unit emits the second sub-light beam and the fourth light-emitting unit emits the fourth sub-light beam to provide the third light, and the intensity composition proportions of the first sub-light beam, the second sub-light beam and the fourth sub-light beam of the third light are different from the intensity composition proportions of the first sub-light beam, the second sub-light beam and the fourth sub-light beam of the first light; when the control unit switches the light-emitting module to the fourth circadian stimulus mode, the first light-emitting unit emits the first sub-light beam, the third light-emitting unit emits the third sub-light beam and the fourth light-emitting unit emits the fourth sub-light beam to provide the fourth light, and the intensity composition proportions of the first sub-light beam, the third sub-light beam and the fourth sub-light beam of the fourth light are different from the intensity composition proportions of the first sub-light beam, the third sub-light beam and the fourth sub-light beam of the second light, wherein the circadian stimulus value of the first sub-light beam is greater than the circadian stimulus value of the second sub-light beam and the circadian stimulus value of the second sub-light beam is greater than the circadian stimulus value of the third sub-light beam.

13. The light source apparatus as claimed in claim 12, wherein the circadian stimulus value of the first light is greater than the circadian stimulus value of the second light by over 5% of the circadian stimulus value of the second light, and the circadian stimulus value of the third light is greater than the circadian stimulus value of the fourth light by over 5% of the circadian stimulus value of the fourth light.

14. The light source apparatus as claimed in claim 11, wherein the control unit makes the light-emitting module respectively switched to the first circadian stimulus mode, the second circadian stimulus mode, the third circadian stimulus mode and the fourth circadian stimulus mode in a plurality of periods of a whole day.

15. The light source apparatus as claimed in claim 1, wherein the circadian stimulus value of the first light is greater than the circadian stimulus value of the second light by over 5% of the circadian stimulus value of the second light.

16. The light source apparatus as claimed in claim 1, wherein the control unit makes the light emitted from the light-emitting module switched between the first light and the second light in a plurality of periods of a whole day.

17. The light source apparatus as claimed in claim 1, wherein the light source apparatus further comprises a user interface, and the control unit decides the present illumination mode of the light source apparatus according to a signal corresponding to the operation of a user sent by the user interface.

18. The light source apparatus as claimed in claim 17, wherein the control unit makes the light-emitting module respectively switched to different illumination modes according to a time management data in a plurality of periods, wherein the time management data is related to biological clock.

19. The light source apparatus as claimed in claim 18, wherein the light source apparatus further comprises a data-writing system, the time management data is received by the control unit through the data-writing system and is stored in a storage unit, and the control unit controls the control unit itself by loading the time management data from the storage unit.

20. The light source apparatus as claimed in claim 19, further comprising a connection interface, wherein the connection interface transmits the time management data come from the data-writing system to the control unit, wherein the connection interface is cable connection interface or wireless connection interface.

21. A light source apparatus, comprising:

a light-emitting module, for providing a light; and a control unit, making the light emitted from the light-emitting module switched between a first light and a second light, wherein a circadian stimulus value of the first light is greater than a circadian stimulus value of the second light by over 5% of the circadian stimulus value of the second light.

22. The light source apparatus as claimed in claim 21, wherein the control unit makes the light-emitting module switched between a plurality of illumination modes, the illumination modes comprise a first circadian stimulus mode and a second circadian stimulus mode, the light-emitting module comprises a plurality of light-emitting units, when the control unit switches the light-emitting module to the first circadian stimulus mode, the control unit makes a first portion of the light-emitting units emit light and when the control unit switches the light-emitting module to the second circadian stimulus mode, the control unit makes a second portion of the light-emitting units emit light, wherein the first portion and the second portion are partially the same as each other or totally different from each other.

23. The light source apparatus as claimed in claim 22, wherein the light-emitting units comprise electroluminescent light-emitting element, light-induced light-emitting element or a combination thereof.

24. The light source apparatus as claimed in claim 23, wherein the light-emitting module comprises at least one first light-emitting unit, at least one second light-emitting unit and at least one third light-emitting unit, the first light-emitting unit provides a first sub-light beam, the second light-emitting unit provides a second sub-light beam and the third light-emitting unit provides a third sub-light beam, the first portion comprises the first light-emitting unit and the second light-emitting unit, the second portion comprises the first light-emitting unit and the third light-emitting unit, when the control unit switches the light-emitting module to the first circadian stimulus mode, the light-emitting units emits the first sub-light beam and the second light-emitting unit emits the second sub-light beam, and when the control unit switches the light-emitting module to the second circadian stimulus mode, the first light-emitting unit emits the first sub-light beam and the third light-emitting unit emits the third sub-light beam, wherein the circadian stimulus value of the second sub-light beam is greater than the circadian stimulus value of the third sub-light beam.

25. The light source apparatus as claimed in claim 24, wherein at least one range of wave peaks of the first sub-light beam is greater than 420 nm but less than 480 nm, at least one range of wave peaks of the second sub-light beam is greater than 480 nm but less than 540 nm and at least one range of wave peaks of the third sub-light beam is greater than 540 nm.

26. The light source apparatus as claimed in claim 25, wherein the first portion further comprises the third light-emitting unit, and if the illumination modes is switched to the first circadian stimulus mode, the third light-emitting unit emits the third sub-light beam.

27. The light source apparatus as claimed in claim 26, wherein the second sub-light beam is produced by the second light-emitting unit stimulated by the first sub-light beam.

28. The light source apparatus as claimed in claim 24, wherein the light-emitting module further comprises at least one fourth light-emitting unit, the fourth light-emitting unit provides a fourth sub-light beam, the first portion comprises the first light-emitting unit, the second light-emitting unit and the fourth light-emitting unit and the second portion comprises the first light-emitting unit, the third light-emitting unit and the fourth light-emitting unit, when the control unit switches the light-emitting module to the first circadian stimulus mode, the first light-emitting unit emits the first sub-light beam, the second light-emitting unit emits the second sub-light beam and the fourth light-emitting unit emits the fourth sub-light beam, and when the control unit switches the light-emitting module to the second circadian stimulus mode, the first light-emitting unit emits the first sub-light beam, the third light-emitting unit emits the third sub-light beam and the fourth light-emitting unit emits the fourth sub-light beam, wherein the circadian stimulus value of the first sub-light beam is greater than the circadian stimulus value of the second sub-light beam and the circadian stimulus value of the second sub-light beam is greater than the circadian stimulus value of the third sub-light beam.

29. The light source apparatus as claimed in claim 28, wherein at least one range of wave peaks of the first sub-light beam is greater than 420 nm but less than 480 nm, at least one range of wave peaks of the second sub-light beam is greater than 480 nm but less than 540 nm, at least one range of wave peaks of the third sub-light beam is greater than 540 nm but less than 590 nm and at least one range of wave peaks of the fourth sub-light beam is greater than 590 nm but less than 680 nm.

30. The light source apparatus as claimed in claim 29, wherein the second sub-light beam is produced by the second light-emitting unit stimulated by the first sub-light beam and the third sub-light beam is produced by the third light-emitting unit stimulated by the first sub-light beam.

31. The light source apparatus as claimed in claim 28, wherein the control unit makes the light emitted from the light-emitting module switched between the first light, the second light, a third light and a fourth light, wherein a circadian stimulus value of the third light is greater than a circadian stimulus value of the fourth light by over 5% of the circadian stimulus value of the fourth light and the color temperatures of the first light and the third light are substantially different from each other.

32. The light source apparatus as claimed in claim 31, wherein the illumination modes further comprise a third circadian stimulus mode and a fourth circadian stimulus mode, when the control unit switches the light-emitting module to the third circadian stimulus mode, the first light-emitting unit emits the first sub-light beam, the second light-emitting unit emits the second sub-light beam and the fourth light-emitting unit emits the fourth sub-light beam to provide the third light, and the intensity composition proportions of the first sub-light beam, the second sub-light beam and the fourth sub-light beam of the third light are different from the intensity composition proportions of the first sub-light beam, the second sub-light beam and the fourth sub-light beam of the first light; when the control unit switches the light-emitting module to the fourth circadian stimulus mode, the first light-emitting unit emits the first sub-light beam, the third light-emitting unit emits the third sub-light beam and the fourth light-emitting unit emits the fourth sub-light beam to provide the fourth light, and the intensity composition proportions of the first sub-light beam, the third sub-light beam and the fourth sub-light beam of the fourth light are different from the intensity composition proportions of the first sub-light beam, the third sub-light beam and the fourth sub-light beam of the second light, wherein the circadian stimulus value of the first sub-light beam is greater than the circadian stimulus value of the second sub-light beam and the circadian stimulus value of the second sub-light beam is greater than the circadian stimulus value of the third sub-light beam.

33. The light source apparatus as claimed in claim 31, wherein the control unit makes the light-emitting module respectively switched to the first circadian stimulus mode, the second circadian stimulus mode, the third circadian stimulus mode and the fourth circadian stimulus mode in a plurality of periods of a whole day.

34. The light source apparatus as claimed in claim 21, wherein the control unit makes the light emitted from the light-emitting module switched between the first light and the second light in a plurality of periods of a whole day.

35. The light source apparatus as claimed in claim 21, wherein the light source apparatus further comprises a user interface, and the control unit decides the present illumination mode of the light source apparatus according to a signal corresponding to the operation of a user sent by the user interface.

36. An illumination device, comprising:

a first light source, for providing a first light with a first circadian stimulus value; and a second light source, for providing a second light with a second circadian stimulus value, wherein the first light and the second light have a substantially same color temperature, and the first circadian stimulus value is different from the second circadian stimulus value.

37. The illumination device as claimed in claim 36, wherein the first circadian stimulus value is greater than the second circadian stimulus value by over 5% of the second circadian stimulus value.

38. The illumination device as claimed in claim 36, further comprising:

at least one first light-emitting unit, having a first light-emitting with at least one wave peak between 420 nm and 480 nm;

at least one second light-emitting unit, having a second light-emitting with at least one wave peak between 480 nm and 540 nm; and at least one third light-emitting unit, having a third light-emitting with at least one wave peak greater than 540 nm, wherein at least the first light-emitting unit and the second light-emitting unit form the first light source, and at least the first light-emitting unit and the third light-emitting unit form the second light source.

39. The illumination device as claimed in claim 38, wherein the first light-emitting unit, the second light-emitting unit and the third light-emitting unit form the first light source.

40. The illumination device as claimed in claim 36, further comprising:

at least one first light-emitting unit, having a first light-emitting with at least one wave peak between 420 nm and 480 nm;

at least one second light-emitting unit, having a second light-emitting with at least one wave peak between 480 nm and 540 nm;

at least one third light-emitting unit, having a third light-emitting with at least one wave peak between 540 nm and 590 nm; and at least one fourth light-emitting unit, having a fourth light-emitting with at least one wave peak greater than 590 nm, wherein at least the first light-emitting unit, the second light-emitting unit and the fourth light-emitting unit form the first light source, and at least the first light-emitting unit, the third light-emitting unit and the fourth light-emitting unit form the second light source.

41. The illumination device as claimed in claim 36, further comprising:

a third light source, for providing a third light with a third circadian stimulus value; and a fourth light source, for providing a fourth light with a fourth circadian stimulus value, wherein the third light and the fourth light have a substantially same color temperature, and the first circadian stimulus value, the second circadian stimulus value, the third circadian stimulus value and the fourth circadian stimulus value are different from each other.

42. The illumination device as claimed in claim 41, further comprising:

at least one first light-emitting unit, having a first light-emitting at least one wave peak between 420 nm and 480 nm;

at least one second light-emitting unit, having a second light-emitting at least one wave peak between 480 nm and 540 nm;

at least one third light-emitting unit, having a third light-emitting at least one wave peak between 540 nm and 590 nm; and at least one fourth light-emitting unit, having a fourth light-emitting at least one wave peak greater than 590 nm, wherein at least the first light-emitting unit, the second light-emitting unit and the fourth light-emitting unit form the first light source, at least the first light-emitting unit, the third light-emitting unit and the fourth light-emitting unit form the second light source, at least the first light-emitting unit and the second light-emitting unit form the third light source and at least the first light-emitting unit and the third light-emitting unit form the fourth light source.

43. The illumination device as claimed in claim 42, further comprising a control unit, wherein the control unit controls the first light-emitting unit, the second light-emitting unit, the third light-emitting unit and the fourth light-emitting unit switched between the first light source, the second light source, the third light source and the fourth light source.

* * * * *